US009783349B2

(12) United States Patent
Buck et al.

(10) Patent No.: US 9,783,349 B2
(45) Date of Patent: Oct. 10, 2017

(54) MOUNTABLE FOOD CONTAINER

(71) Applicant: SnackTops, Inc., Carlsbad, CA (US)

(72) Inventors: Ronald Mark Buck, Encinitas, CA (US); Allen Tucker, Vista, CA (US)

(73) Assignee: SnackTops, Inc., Carlsbad, CA (US)

( * ) Notice: Subject to any disclaimer, the term of this patent is extended or adjusted under 35 U.S.C. 154(b) by 0 days.

(21) Appl. No.: 15/401,029

(22) Filed: Jan. 7, 2017

(65) Prior Publication Data

US 2017/0203893 A1 Jul. 20, 2017

Related U.S. Application Data

(60) Provisional application No. 62/280,408, filed on Jan. 19, 2016, provisional application No. 62/298,924, filed on Feb. 23, 2016.

(51) Int. Cl.
*B65D 51/28* (2006.01)
*B65D 43/02* (2006.01)
(Continued)

(52) U.S. Cl.
CPC ..... *B65D 51/28* (2013.01); *A47G 19/2272* (2013.01); *A47G 21/18* (2013.01);
(Continued)

(58) Field of Classification Search
CPC ..... B65D 23/00; B65D 51/28; B65D 51/24; B65D 43/02; B65D 43/16; B65D 21/0217; B65D 21/0209; B65D 21/02; B65D 21/0202; B65D 21/0204; B65D 21/0201; B65D 69/00; B65D 1/023; B65D 1/0223; B65D 1/02; A47G 19/2272; A47G 21/18
USPC ..... 220/703, 735, 23.86, 23.83, 4.27, 4.26; 215/387, 386, 390, 235, 237; 206/504, 206/508, 518, 515, 541, 223, 577, 217, 206/216
See application file for complete search history.

(56) References Cited

U.S. PATENT DOCUMENTS 3,201,015 A * 8/1965 Wagaman ..... B65D 51/28 141/332
4,264,007 A * 4/1981 Hunt ..... B65D 51/2842 206/219
(Continued)

FOREIGN PATENT DOCUMENTS

WO 9826998 A1 6/1998
WO 2007073350 A1 6/2007

OTHER PUBLICATIONS

International Search Report and Written Opinion dated Mar. 31, 2017 in PCT/US2017/012751 (10 pages).

*Primary Examiner* — Robert J Hicks
(74) *Attorney, Agent, or Firm* — Manuel de la Cerra

(57) ABSTRACT

A food container coupling system includes a food container configured to attach to a bottle coupler. The food container includes a food compartment with a side wall and a bottom, which has a food compartment coupling structure extending therefrom. The system also includes a bottle coupler with a top rim and a bottle coupler coupling structure extending from the top rim. The bottle coupler further has an annular opening adapted to fit around the neck of a bottle, a small can or a large can. When the food container is mounted to the bottle coupler, the food compartment coupling structure mates with the bottle coupler coupling structure.

9 Claims, 33 Drawing Sheets

LINE E-E

(51) Int. Cl.

| | |
|---|---|
| ***B65D 43/16*** | (2006.01) |
| ***B65D 21/02*** | (2006.01) |
| ***A47G 19/22*** | (2006.01) |
| ***A47G 21/18*** | (2006.01) |

(52) U.S. Cl.
CPC ..... *B65D 21/0209* (2013.01); *B65D 43/02* (2013.01); *B65D 43/16* (2013.01); *B65D 2543/00046* (2013.01)

(56) References Cited

U.S. PATENT DOCUMENTS

| | | | | |
|---|---|---|---|---|
| 6,085,919 | A * | 7/2000 | Singer | A63H 1/30 206/217 |
| 6,338,417 | B1 | 1/2002 | Ferraro | |
| 7,726,512 | B2 | 6/2010 | MacCarthy | |
| 8,672,175 | B2 | 3/2014 | Farmer | |
| 8,939,312 | B1 * | 1/2015 | Buck | A47G 19/065 220/212 |
| 2007/0221513 | A1 * | 9/2007 | Taylor-Sharp | B65D 81/3211 206/219 |
| 2007/0289670 | A1 * | 12/2007 | Johns | B65D 81/3211 141/383 |
| 2008/0067084 | A1 * | 3/2008 | Patterson | B65D 51/2892 206/219 |
| 2009/0283047 | A1 | 11/2009 | Swenson et al. | |
| 2010/0260901 | A1 * | 10/2010 | Zoss | A47G 19/02 426/120 |
| 2011/0278184 | A1 | 11/2011 | Middleman et al. | |
| 2011/0290817 | A1 | 12/2011 | Weiss et al. | |
| 2013/0228486 | A1 * | 9/2013 | Buck | B65D 21/0238 206/459.1 |

* cited by examiner

LINE A-A

ENLARGEMENT D

LINE A-A

ENLARGEMENT B

LINE E-E

ENLARGEMENT F

LINE E-E

ENLARGEMENT F

LINE A-A

ENLARGEMENT D

LINE J-J

LINE C-C

ENLARGEMENT G

LINE H-H

ENLARGEMENT H

LINE J-J

ENLARGEMENT J

MOUNTABLE FOOD CONTAINER

RELATED APPLICATIONS

This application claims priority as a non-provisional application to U.S. Patent Application 62/280,408 entitled "MOUNTABLE FOOD CONTAINER" filed on Jan. 19, 2016, and as a non-provisional application to U.S. Patent Application 62/298,924 entitled "MOUNTABLE FOOD CONTAINER" filed on Feb. 23, 2016, both of which are incorporated herein by reference in their entirety.

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; U.S. patent application Ser. No. 14/274,576 entitled "A CONTAINER LID WITH A FOOD COMPARTMENT AND A SIP-HOLE" filed on May 9, 2014; U.S. patent application Ser. No. 14/313,907 entitled "A CONTAINER LID SYSTEM WITH A LID PORTION AND FOOD CONTAINER PORTION" filed on Jun. 24, 2014; U.S. Patent Application Ser. No. 62/005,862 entitled "A CONTAINER LID SYSTEM WITH A LID PORTION AND FOOD CONTAINER PORTION" filed on May 30, 2014; U.S. Patent Application 62/038,199 entitled "A CONTAINER LID SYSTEM WITH TAMPER INDICATOR" filed on Aug. 15, 2014; U.S. patent application Ser. No. 29/500,266 entitled "BENDABLE DRINKING STRAW" filed on Aug. 22, 2014; U.S. Patent Application 62/105,256 entitled "BENDABLE SAFETY STRAW AND LIDS WITH FOOD COMPARTMENT" filed on Jan. 20, 2015; U.S. patent application Ser. No. 14/986,701 entitled "BEVERAGE LID THAT ATTACHES TO FOOD CONTAINER" filed on Jan. 3, 2016 and U.S. patent application Ser. No. 14/986,703 entitled "CUP LID WITH INTEGRATED CONTAINER" filed on Jan. 3, 2016 all of which are by the same inventor of the present application. Each of these applications is incorporated herein by reference.

TECHNICAL FIELD

The present invention relates to lids for disposable or reusable containers, and particularly to a new and novel food container.

BACKGROUND

The increased popularity of fast food establishments, coupled with the popularity for consumption of food on-the-go has led to the need for more convenient carrying of beverages, snacks and food.

Billions of disposable beverage containers are used every year. Often those containers are part of a larger meal, and current technology dictates placing a lid on the beverage container and packing the food and snacks in separate and detached containers or bags. This may be satisfactory for a consumer seated at a table. However, when the consumer must eat on-the-go, use of the current technology is problematic. Consider, for example, a consumer who is drinking a beverage and would like to access a breakfast sandwich in a takeout bag. The consumer must set aside the beverage, and then use one hand to hold the bag and the other hand to access the sandwich, then set aside the bag and use both hands to open the sandwich packaging. As shown in this example, current technology does not allow for convenient on-the-go consumption. Standard cup lids are simple covers that do not include an integrated container or a system of coupling to top mounted food containers. Rather, known lids cover the contents of a cup which forms a closed container in combination with the cup itself The inventor of the present invention has disclosed several food container systems that work with existing, or custom, beverage containers to solve some of the prior art shortcomings. Disclosed herein are yet other lids, food containers and coupling structures that overcome the prior art shortcomings and foster convenient on-the-go eating.

SUMMARY

The present invention provides an elegant solution to the needs described above and offers numerous additional benefits and advantages, as will be apparent to persons of skill in the art. A food container coupling system is disclosed that includes a food container configured to attach to a bottle coupler. The food container includes a food compartment with a side wall and a bottom, which has a food compartment coupling structure extending therefrom. The system also includes a bottle coupler with a top rim and a bottle coupler coupling structure extending from the top rim. The bottle coupler further has an annular opening adapted to fit around the neck of a bottle. When the food container is mounted to the bottle coupler, the food compartment coupling structure mates with the bottle coupler coupling structure.

In some embodiments, the bottle coupler may include at least one bottle neck securing structure adapted to place pressure against the bottle and stabilize the position of the bottle coupler to the bottle. The annular opening of the bottle coupler may be further configured to fit around a small can and the bottle coupler may include a small can coupling structure adapted to secure the bottle coupler to the rim of the small can such that when the bottle coupler is mounted to a small beverage can, the small can coupling structure hooks underneath the rim of the small can.

In yet another embodiment, the annular opening of the bottle coupler may be further configured to fit around a large can such that the bottle coupler includes a large can coupling structure configured to secure the bottle coupler to the rim of the large can. When the bottle coupler is mounted to a large beverage can, the large can coupling structure hooks underneath the rim of the large can.

A food container coupling system that includes a food container configured to attach to a beverage container lid/coupler is also disclosed. The food container includes a food compartment with a side wall, a bottom and a food compartment coupling structure extending from the bottom. The beverage container lid/coupler includes a beverage container lid coupling ring adapted to mate with the rim of a beverage container, wherein the rim defines a plane. Extending from the beverage container lid coupling ring may be a surface in substantially the same plane as the rim. A beverage container lid coupling structure extends away from the surface. When the food container is mounted to the beverage container lid/coupler, the food compartment coupling structure mates with the beverage container lid coupling structure.

In another embodiment, the lid/coupler may have a hole to access the contents of the beverage container, or a vent hole.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

DETAILED DESCRIPTION

Figure 1:
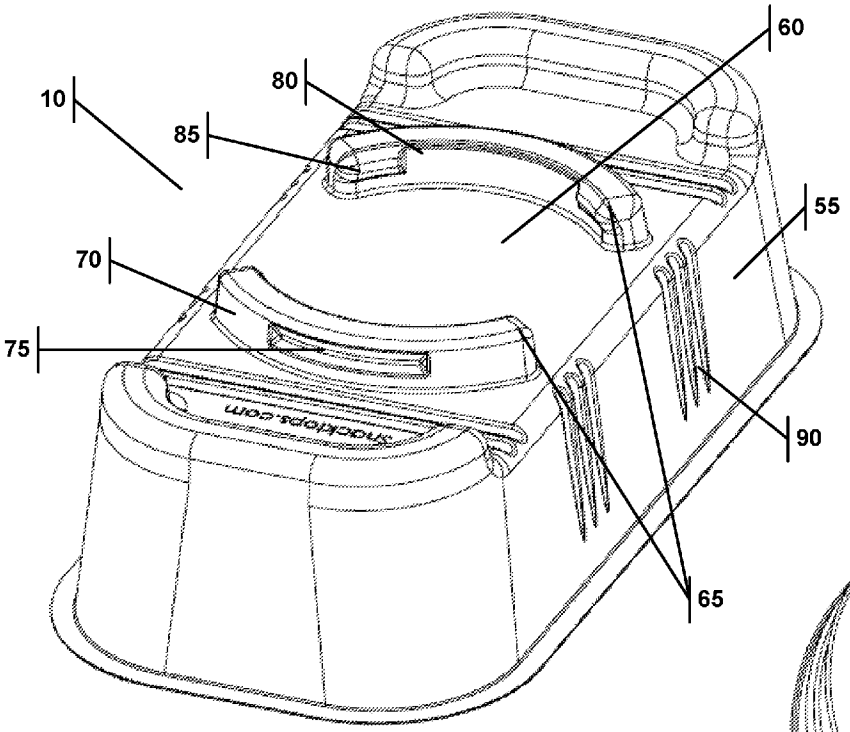
FIG. 1 is a bottom perspective view of a novel food container.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship, or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1-39B and is provided for ease of reference, where like reference numerals designate corresponding features throughout the specification and figures:

Food container 10
Second embodiment of food container 10-2
Third embodiment of food container 10-3
Fourth embodiment of food container 10-4
Beverage container lid/coupler 15
Beverage container 16
Lid wall 20
Lid coupling structure 25
1st radius 30
Large beverage can 35
Can rim 40
2nd radius 45
3rd radius 48
Food compartment 50
Side wall 55
Bottom 60
Food compartment coupling structure 65
Food compartment coupling structure (embodiment three) 65-1
Outer wall 70
Outer wall coupling structure 75
Inner wall 80
Inner wall coupling structure 85
Inner wall jut 86
Outer wall jut 87
Out wall channel 88
Strengthening ribs 90
Food compartment coupling structure minor arcs 95*a, b*
Cover 100
Hinge 105
Inner can coupler 110
Small beverage can (12 oz) 115
Rim 120
Bottle coupler 125
Bottle 130
Bottle neck 135
Bottle coupler top rim 137
Bottle coupler inner wall 138
Bottle coupler coupling structure 140
Bottle neck securing structure 145
Bottle/small can/large can coupler 150
Bottle/small can/large can coupler coupling structure 155
Bottle neck securing structure 160
Small can coupling structure 165
Large can coupling structure 170
Food container ring coupling structure 175
Second embodiment of a beverage container lid/coupler 180
Third embodiment of a beverage container lid/coupler 180-2
Fourth embodiment of a beverage container lid/coupler 180-3
Fifth embodiment of a beverage container lid/coupler 180-4
Sixth embodiment of a beverage container lid/coupler 180-5
Seventh embodiment of a beverage container lid/coupler 180-6
Beverage container lid hole 185
Beverage container lid vent hole 190
Beverage container lid rim 195
Beverage container lid surface 197
Beverage container lid coupling structure 200
Beverage container lid coupling structure jut 200-1
Food container cover coupling structure 205
Straw 210
Beverage container center line 215
Beverage container cover coupling structure center line 220
Offset 225

Referring to FIG. 1, the present invention is a food container 10 that has structures allowing the bottom of the food container 10 to be mounted on top of a beverage container, a can, or even a bottle by mating with a compatible coupling structure. The embodiment shown in FIG. 1 includes the following features: the bottom 60 of the container 10, the side walls 55, strengthening ribs 90, and the food compartment coupling structure 65, which extends from the bottom 60 and is comprised of the outer wall 70 with an outer wall coupling structure 75 and the inner wall 80 with an inner wall coupling structure 85. The food compartment coupling structure 65 shown in FIG. 1 is mated to the lid coupling structure 25 shown in FIG. 2.

Figure 2:
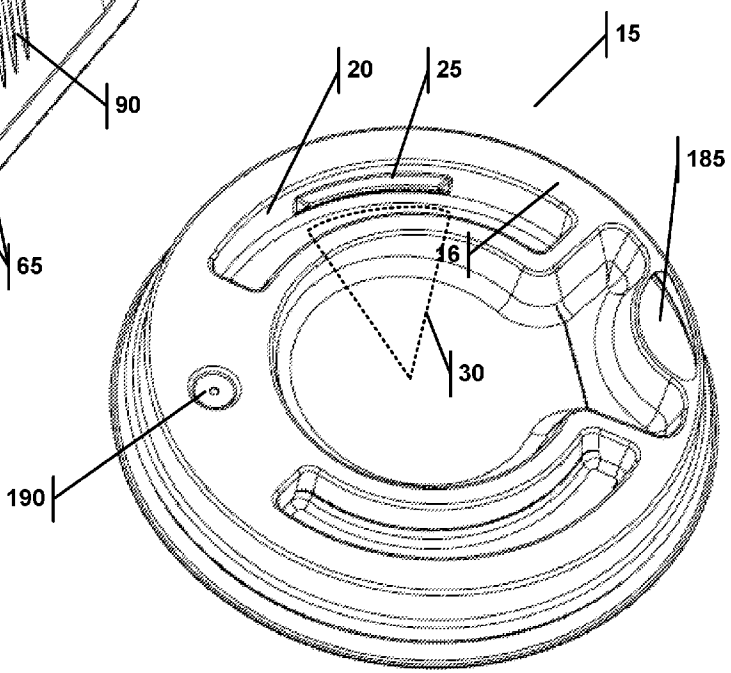
FIG. 2 is a top perspective view of a beverage container lid/coupler.

FIG. 2 shows a beverage container lid/coupler 15 with a lid wall 20 and a lid coupling structure 25 that is shaped to join with the food compartment coupling structure 65 of the food container 10. The lid coupling structure 25 may be symmetrically situated as a pair of minor arcs from the center of the beverage container lid/coupler 15 at a first radius 30, which matches the radius of the outer wall 70 and the outer wall coupling structure 75 in both minor arcs of the food compartment coupling structure 65. The pair of minor symmetrical arcs may also be configured as a continuous ring or plugs.

Figure 3A:
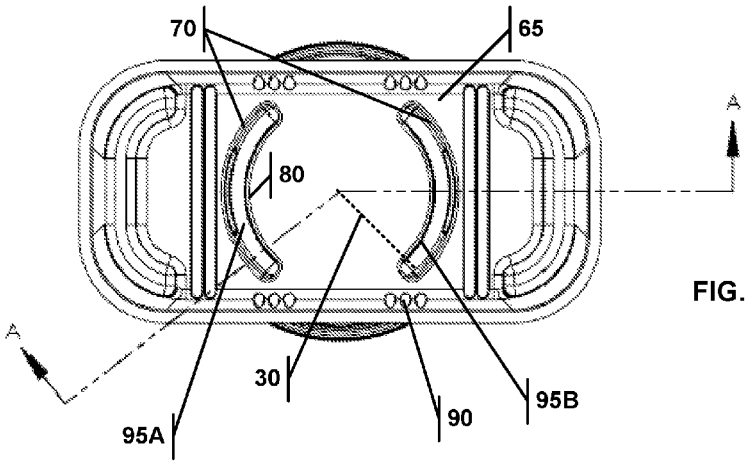
FIG. 3A is a top plan view of the novel food container mounted to a beverage container lid/coupler.
Figure 3B:
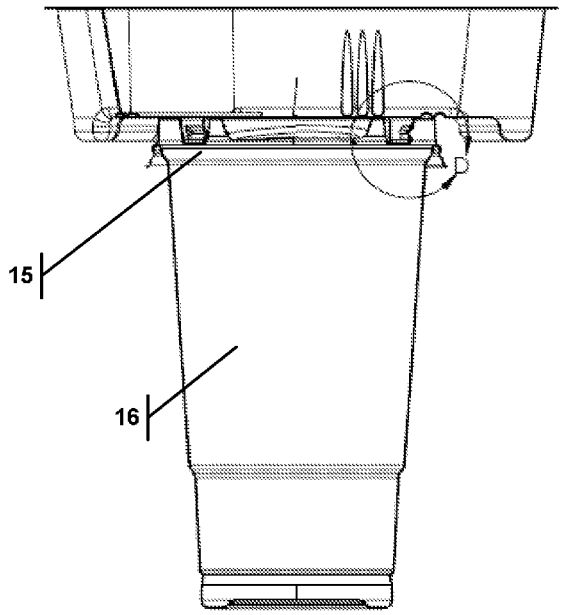
FIG. 3B is a cross-sectional view along line A-A of FIG. 3A.
Figure 3C:
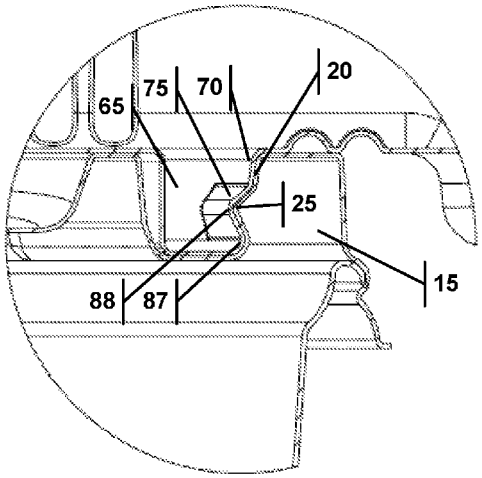
FIG. 3C is an enlarged cross-sectional view illustrating the mating of the lid coupling structure to the food compartment coupling structure.

FIGS. 3A-C illustrate in detail how the food compartment coupling structure 65 mates with the lid coupling structure 25 so that the food container 10 may be mounted on top of a beverage container 16. FIG. 3A provides a top plan view showing the food compartment coupling structure 65. Also illustrated are the outer walls 70, the inner wall 80, and the strengthening ribs 90. The outer walls 70 of the food compartment coupling structure 65 have a first radius 30. While the food compartment coupling structure 65 could be any shape, in one variation it could form a minor arc. In particular to what is drawn in FIG. 3A, the food compartment coupling structure 65 may be comprised of the food compartment coupling structure minor arcs 95A and 95B, as shown. It should be understood however, that the depiction of the food compartment coupling structure 65 as consisting of minor arcs 95A and 95B does not limit the food compartment coupling structure 65 to minor arcs. FIG. 3B is a cross-sectional view along line A-A shown in FIG. 3A. Section D in FIG. 3B is enlarged as FIG. 3C, which provides a more detailed look at how the two coupling structures may work together.

In FIG. 3C, the lid wall 20 and lid coupling structure 25 features belong to the beverage container lid/coupler 15, while the outer wall coupling structure 75, including the outer wall jut 87 and the outer wall channel 88 are a part of the food compartment coupling structure 65. The outer wall coupling structure 75 may feature an outer wall jut 87 that juts away from the outer wall 70, or an outer wall channel 88 that fits with a protrusion in the lid coupling structure 25, or may feature both an outer wall just 87 and an outer wall channel 88, as illustrated. Note that while the enlarged cross-sectional view here illustrates the food compartment coupling structure minor arc 95B, the other minor arc 95A is symmetrical and works the same way, with an outer wall coupling structure 75 that may feature an outer wall just 87, an outer wall channel 88, or both an outer wall just 87 and an outer wall channel 88. As a modification foreseeable by one practiced in the art, the lid coupling structure 25 could have any cross-sectional shape that is complimentary to the cross-sectional shape of the outer wall coupling structure 75, to ensure that the two coupling structures 25 and 75 mate together so that the food container 10 and the beverage container 16 can be joined.

Figure 4A:
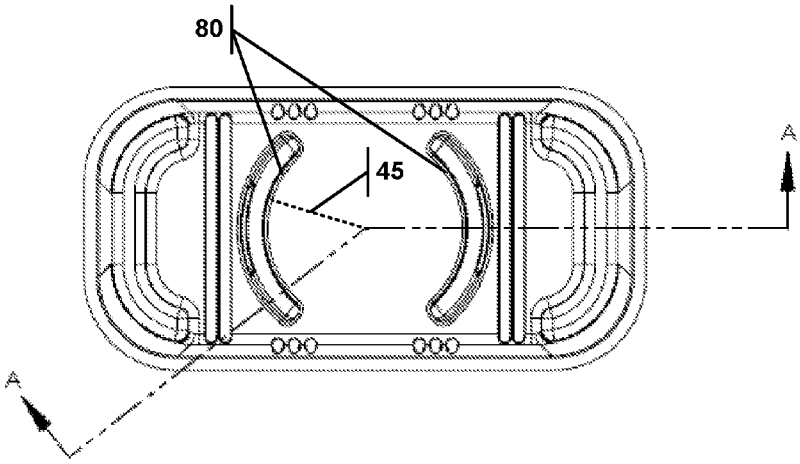
FIG. 4A is a top plan view of the novel food container mounted to a beverage can.
Figure 4B:
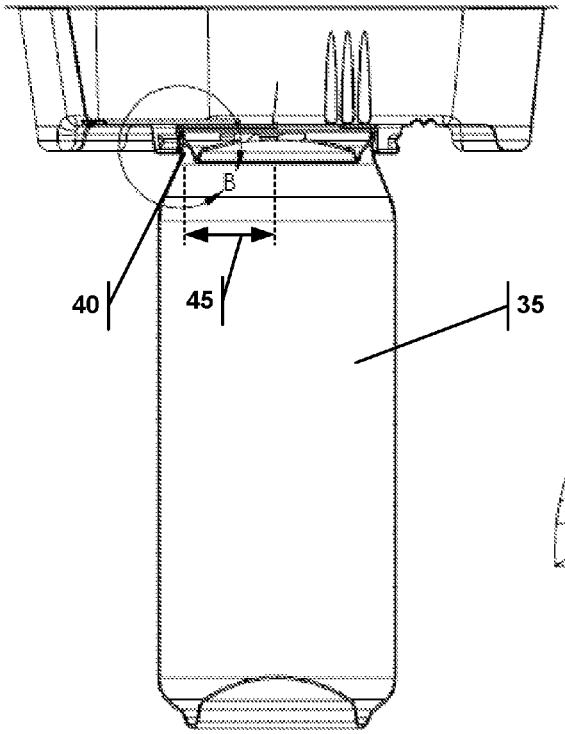
FIG. 4B is a cross-sectional view along line A-A of FIG. 4A.
Figure 4C:
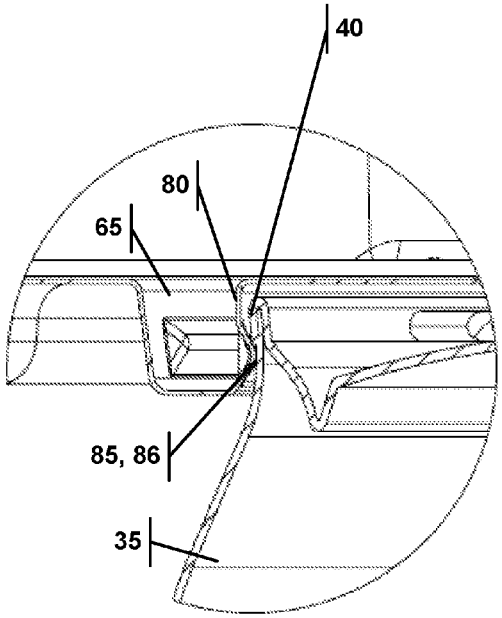
FIG. 4C is an enlarged cross-sectional view illustrating the mating of the lid coupling structure to the rim of a beverage can.

FIGS. 4A-C indicate how the same food container 10 may be mounted on top of a beverage can 35. FIG. 4A provides the same top plan view, while FIG. 4B provides a cross-sectional view along the line A-A drawn in FIG. 4A. In comparing FIG. 3B with FIG. 4B, note that while in FIG. 3B the outer wall 70 couples with the beverage container lid/coupler 15, in FIG. 4B it is the inner wall 80 of the same food compartment coupling structure 65 that couples with the can rim 40 of the beverage can 35. The inner wall 80 has a second radius 45, which matches the radius of the top of the beverage can 35. Section B in FIG. 4B is enlarged as FIG. 4C to better demonstrate how the food container 10 may be mounted atop a large beverage can 35.

In FIG. 4C, the inner wall coupling structure 85 includes an inner wall jut 86 that juts away from the inner wall 80 of the food compartment coupling structure 65 to grip the rim 40 of the large beverage can 35. The inner wall jut 86 secures the food container 10 to the rim 40 of the beverage can 35. While in FIGS. 4A-C a larger radius (25 oz) beverage can 35 is illustrated, the inner wall coupling structure 85 works in the same way with smaller beverage cans of the same can radius, since beverage cans could have a standard rim diameter that matches the diameter of the inner wall 80 of the food compartment coupling structure 65. It would be apparent to those skilled in the art, that the radius of the food compartment coupling structure 65 can be changed to accommodate cans with larger or smaller radiuses.

Figure 5:
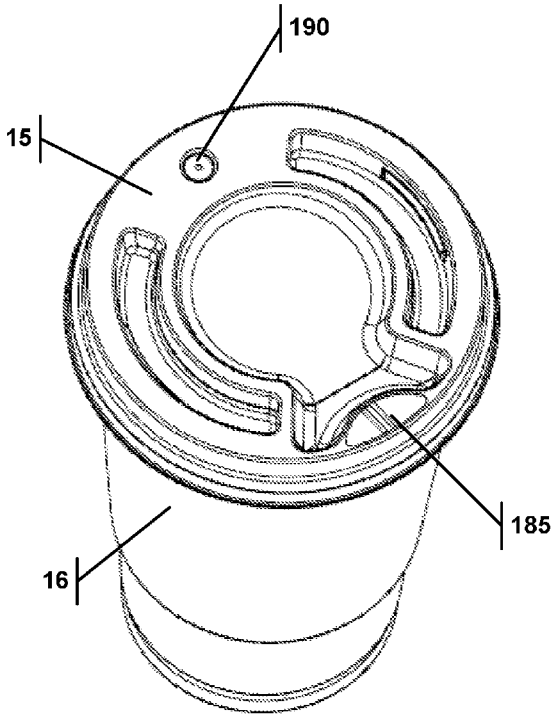
FIG. 5 is a top perspective view of the beverage lid mounted to a beverage container.
Figure 6:
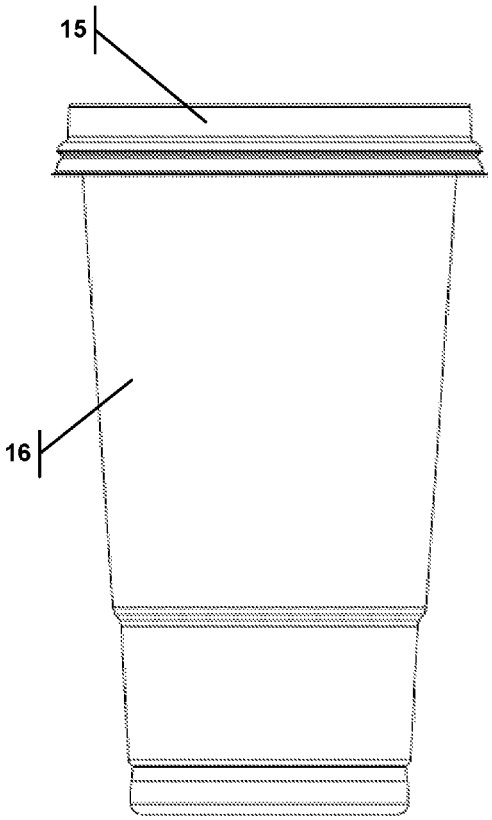
FIG. 6 is a side view of the beverage lid mounted to a beverage container.
Figure 7:
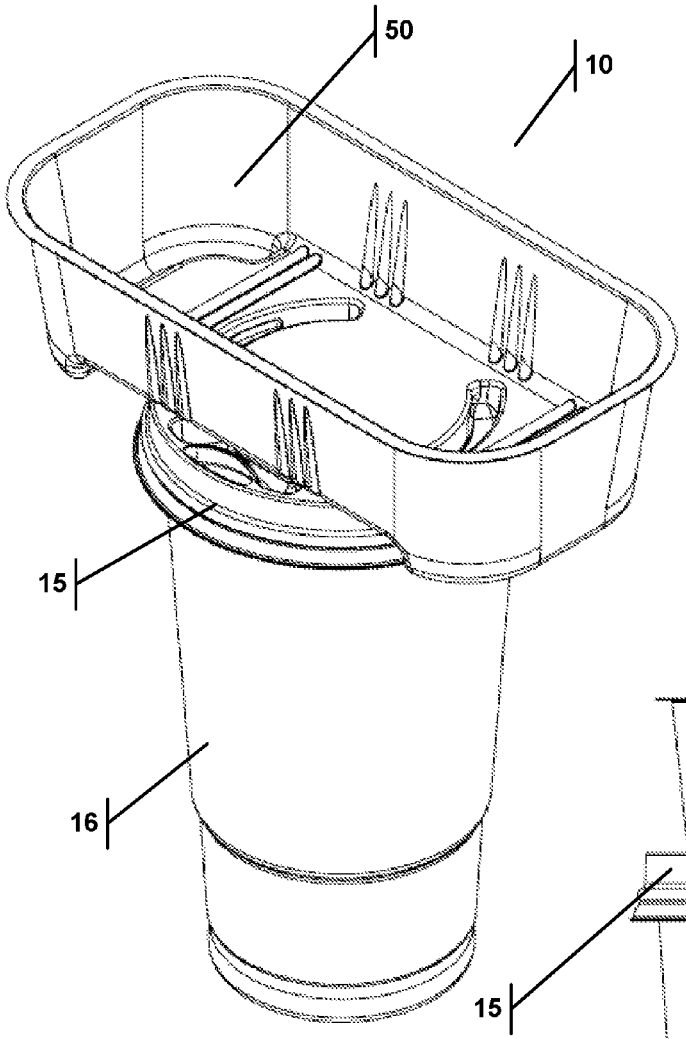
FIG. 7 is a top perspective view of the food container mounted to the beverage container lid/coupler.
Figure 8:
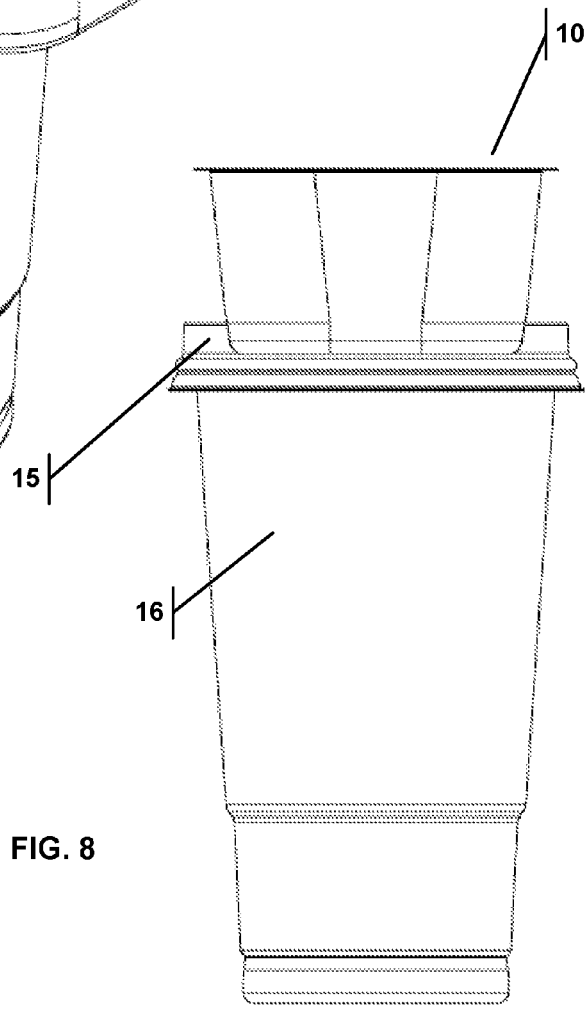
FIG. 8 is a side view of the food container mounted to the beverage container lid/coupler.
Figure 9:
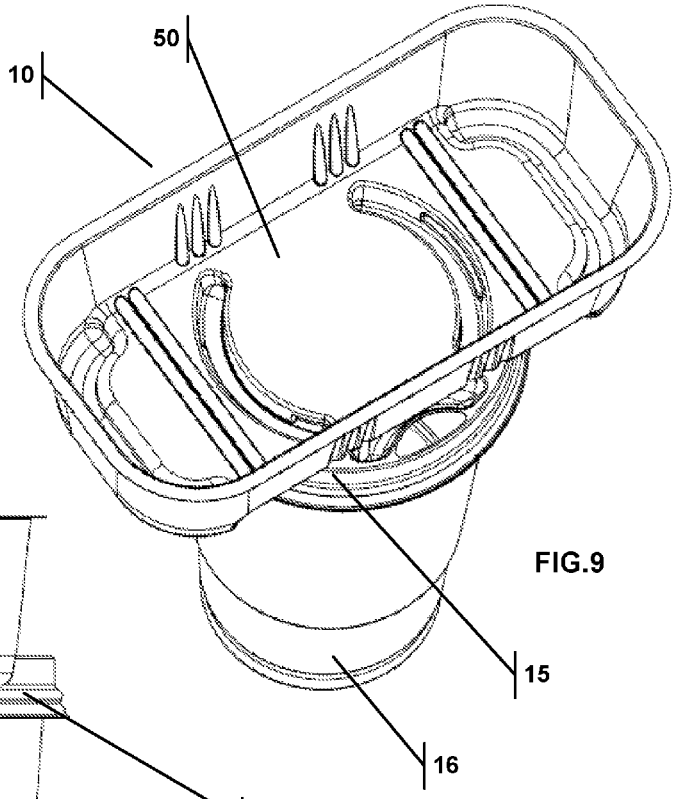
FIG. 9 is a top perspective view of the food container mounted to the beverage container lid/coupler.
Figure 10:
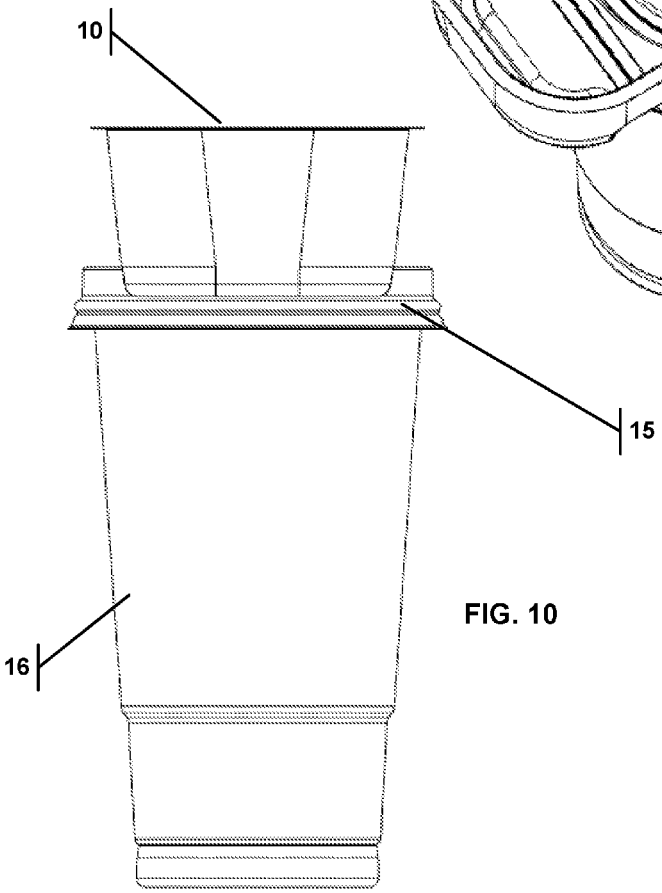
FIG. 10 is a side view of the food container mounted to the beverage container lid/coupler.

FIGS. 5-10 provide various views of the beverage container lid/coupler 15 provided in FIG. 2, and the food container 10 embodiment shown in FIG. 1, as well as how they may work together. FIG. 5 provides a top perspective view and FIG. 6 provides a side view of the beverage container lid/coupler 15 fitted over a beverage container 16. FIG. 7 is a top perspective view of the food container 10 mounted over the beverage container 16. The food compartment 50 is visible, but the food compartment coupling structure 65 is not visible beneath the food compartment 50. Part of the beverage container lid/coupler 15 is visible in FIG. 7, but the lid coupling structure 25 is likewise not visible in this perspective view. FIG. 8 provides a side view of the food container 10 mounted atop the beverage container 16. FIG. 9 provides another top perspective view, this time from a different direction, and FIG. 10 provides another side view.

Figure 11:
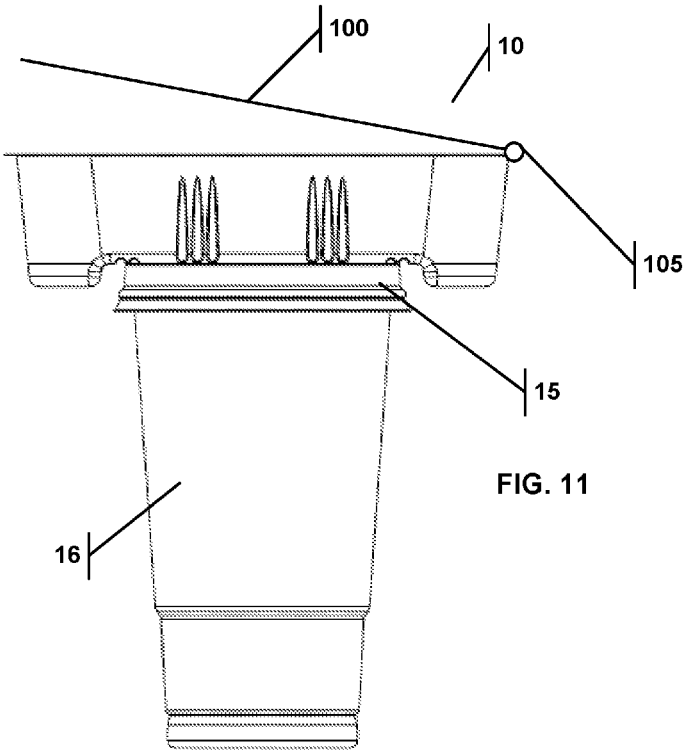
FIG. 11 is a side view of the food container mounted to the beverage container lid/coupler, wherein the food container has a cover and a hinge.
Figure 12:
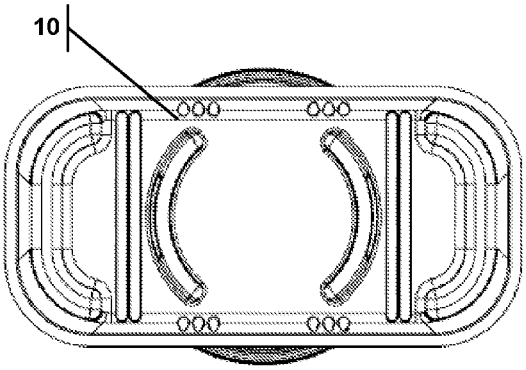
FIG. 12 is a top plan view of the food container mounted to the beverage container lid/coupler.
Figure 13:
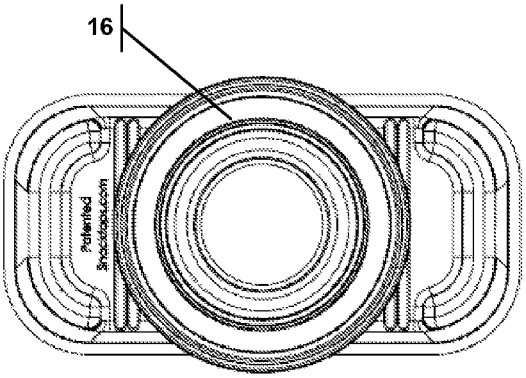
FIG. 13 is a bottom plan view of the food container mounted to the beverage container lid/coupler.

FIG. 11 shows another side view of the food container 10 mounted atop the beverage container 16. In this view, the food container 10 is illustrated as having a cover 100 and a hinge 105 that connects the cover 100 to the side wall 55. These are optional additions to the embodiment. The invention may have no cover 100, have a seal-on cover, have a cover 100 that does not hinge and may, as a non-limiting example, snap on to the side walls 55 of the food container 10, or have a cover 100 with a hinge 105, as illustrated. FIG. 12 provides a top plan view of the food container 10 mounted to the beverage container 16, and FIG. 13 is a bottom plan view of the same.

Figure 14:
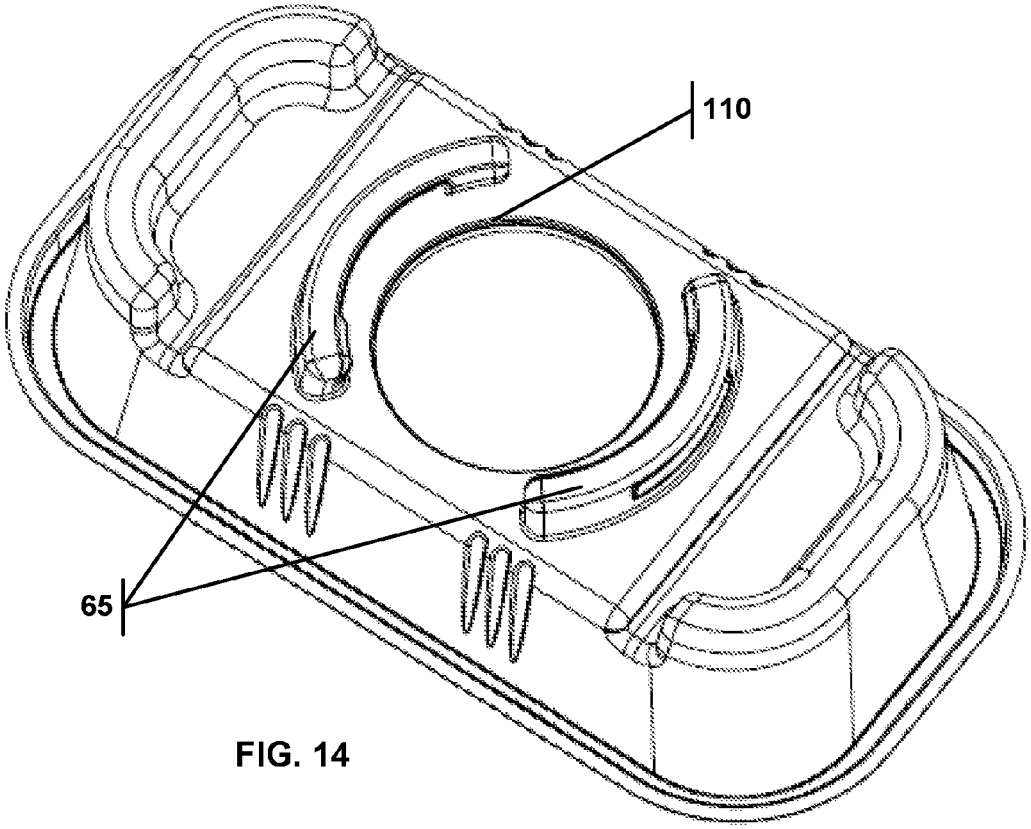
FIG. 14 is a bottom perspective view of a food container with an inner can coupler that allows for direct coupling to a smaller beverage can.
Figure 15:
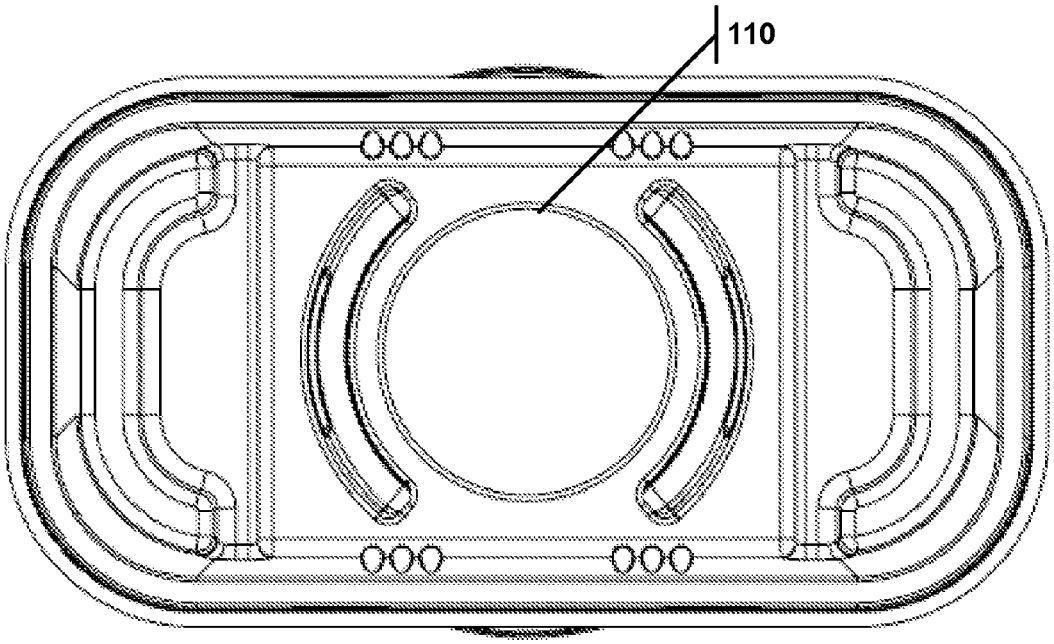
FIG. 15 is a top plan view of the food container of FIG. 14.

FIGS. 14-16 illustrate an option to have an inner can coupler 110, which can grip the rim and/or hook underneath the rim of a different diameter size can. As seen in FIG. 14, this inner can coupler 110 is located along the bottom 60 of the food container 10, situated inside the minor arcs 95A and 95B of the food compartment coupling structure 65. As shown by FIG. 15, the inner can coupler 110 has a radius smaller than the second radius 45 of the inner wall 80 of the food compartment coupling structure 65, which enables the same food container 10 to be attachable to two different diameter size cans; the can diameter sizes correspond to the diameter of the inner can coupler 110 and the inner wall 80 of the food compartment coupling structure 65.

Figure 16A:
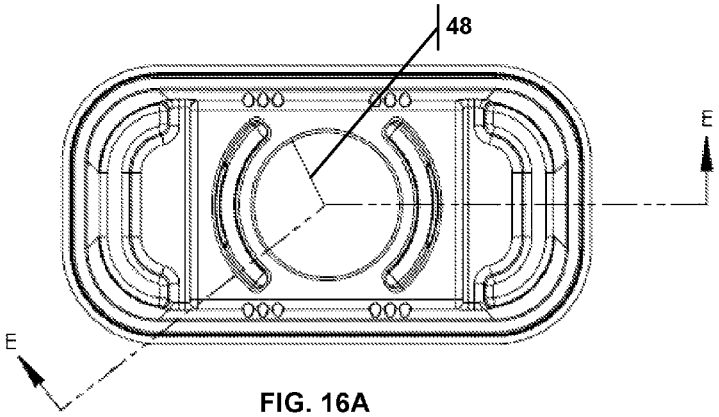
FIG. 16A is a top plan view of the novel food container mounted to a small beverage can.
Figure 16B:
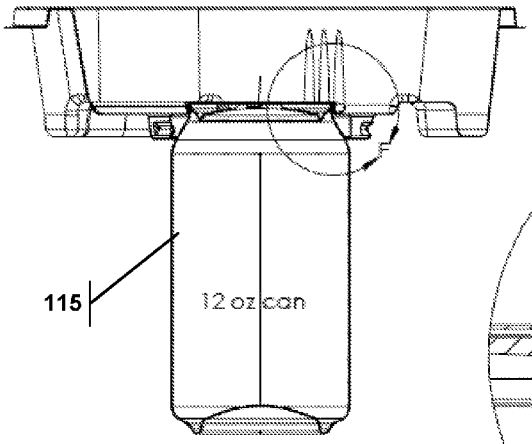
FIG. 16B is a cross-sectional view along line E-E of FIG. 16A.
Figure 16C:
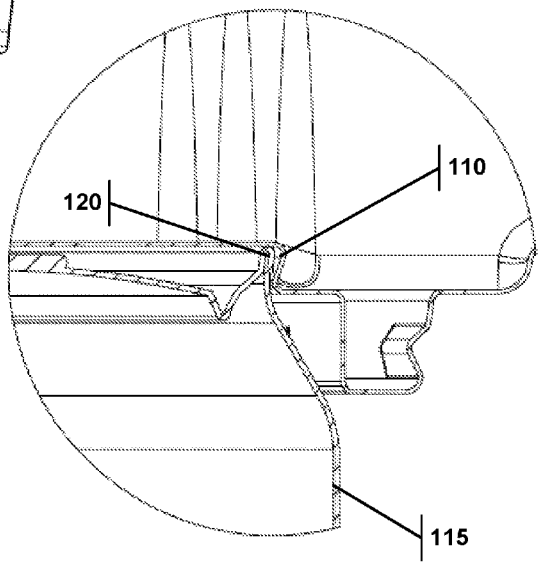
FIG. 16C is an enlarged cross-sectional view illustrating the mating of the lid coupling structure to the rim of a beverage can.

FIG. 16A shows the top plan view, as well as a line E-E along which a cross-sectional view is provided in FIG. 16B. In FIG. 16B, the food container 10 is mounted atop a smaller diameter beverage can 115. Section F of FIG. 16B is magnified into the enlarged cross-sectional non-standard view shown in FIG. 16C, which shows that the inner can coupler 110 grips the rim 120 of the beverage can 115 by hooking underneath the rim 120.

Note that the inner can coupler 110 has a third radius 48, drawn in FIG. 16A, which is smaller than the second radius 45 of the inner wall coupling structure 85, which is in turn smaller than the first radius 30 of the outer wall coupling structure 75. Thus the food container 10 may be mounted to a larger diameter beverage can 35 by having the inner wall coupling structure 85 of the food compartment coupling structure 65 hook underneath the rim 40 of a larger diameter beverage can 35, or mounted to a smaller diameter beverage can 115 by having the inner can coupler 110 hook underneath the rim 120 of a smaller diameter beverage can 115, or mounted to a beverage container 16 by having the outer wall coupling structure 75 mate with the lid coupling structure 25 on a beverage container lid/coupler 15. The food container 10 disclosed by the present invention can be conveniently mounted atop a variety of beverage containers, including at least two different diameter cans. FIGS. 17-23 show the food container 10 is also mountable onto a bottle 130 via a bottle coupler 125.

Figure 17A:
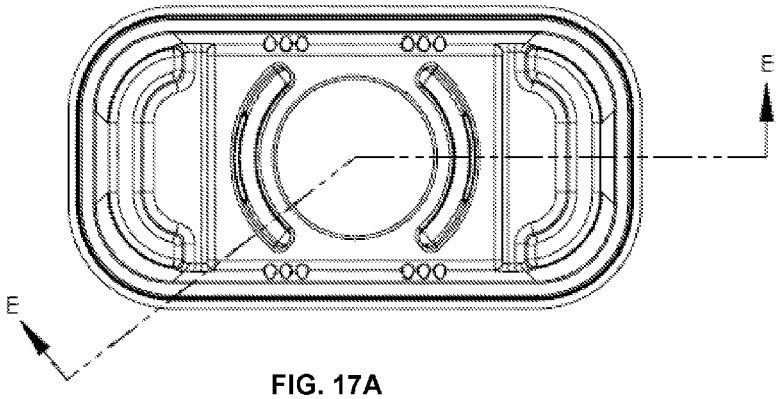
FIG. 17A is a top plan view of the novel food container mounted to a bottle by use of a bottle coupler.
Figure 17B:
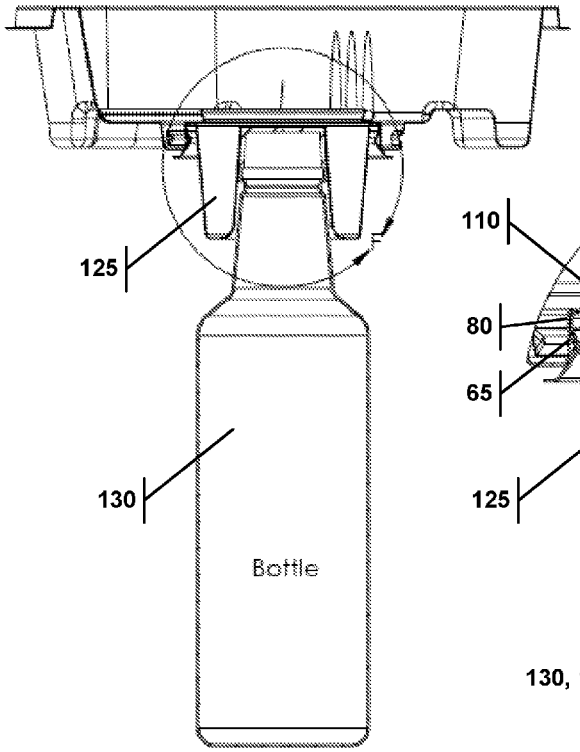
FIG. 17B is a cross-sectional view along line E-E of FIG. 17A.
Figure 17C:
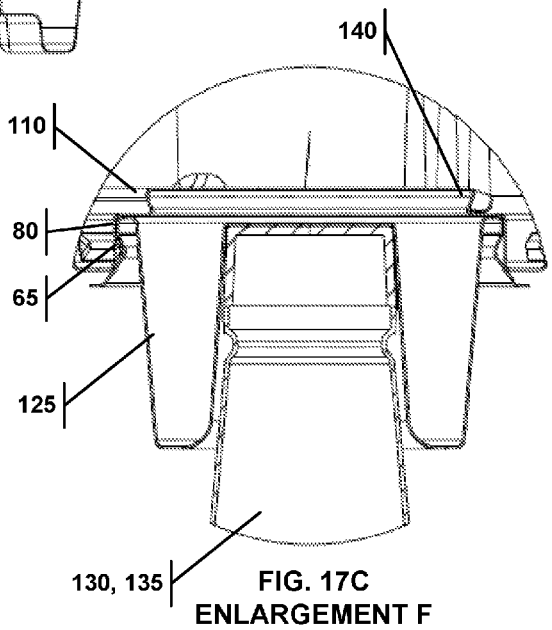
FIG. 17C is an enlarged cross-sectional view illustrating the mating of the bottle coupler to a food container, and the bottle coupler mounted to the bottle.

FIG. 17B, which shows a cross-sectional view of the food container 10 attached to a bottle 130 with a bottle coupler 125, is a view along line E-E of FIG. 17A. Section F in FIG. 17B is enlarged in FIG. 17C, which shows the bottle coupler 125 fitting onto the bottle neck 135 of the bottle 130. The bottle coupler 125 has a bottle coupler coupling structure 140, which mates with the inner can coupler 110. As illustrated in FIG. 17C, the bottle coupler 125 couples with the inner can coupler 110, and the inner wall 80 of the food compartment coupling structure 65. As an alternative option, the bottle coupler 125 may instead be of a smaller outer diameter that matches with the inner can coupler 110 diameter on the food compartment coupling structure 65, so that the bottle coupler 125 may optionally attach to the inner can coupler 110 of the food compartment coupling structure 65 instead of the inner wall 80 of the food compartment coupling structure 65.

Figure 18A:
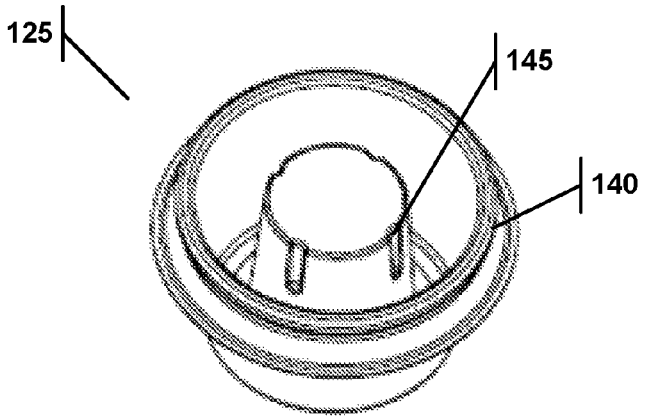
FIG. 18A is a top perspective view of the bottle coupler illustrated in FIGS. 17A-17C.
Figure 18B:
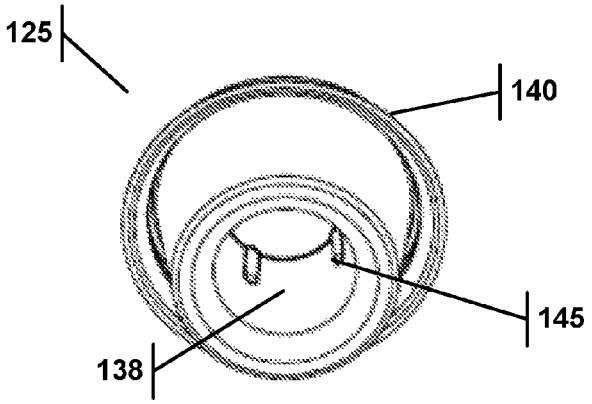
FIG. 18B is a bottom perspective view of the bottle coupler illustrated in FIGS. 17A-17C.
Figure 18C:
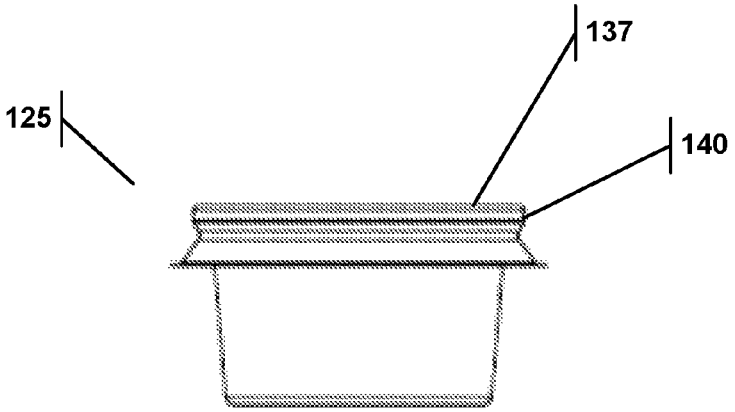
FIG. 18C is a side view of the bottle coupler illustrated in FIGS. 17A-17C.

FIGS. 18A, 18B, and 18C, respectively, provide a top perspective, a bottom perspective, and a side view of the bottle coupler 125. The bottle coupler 125 features a bottle coupler coupling structure 140 and a bottle neck securing structure 145. The inner wall (annular opening) 138 of the bottle coupler 125 fits snugly around the bottle neck 135 on a bottle 130. The bottle neck securing structure is adapted to place pressure against the bottle and stabilize the position of the bottle coupler 125 to the bottle 130. The bottle coupler 125 has a bottle coupler coupling structure 140 with a larger radius that extends from the top rim 137 and mates to the appropriate coupling mechanism on the food container 10. The top rim 137 can optionally jut out from the bottle coupler coupling structure 140, so that the coupling structure it mates with can hook underneath the top rim 137. Depending on the diameter of the top rim 137, it may couple with the inner can coupler 110 or the inner wall coupling structure 80 of the food compartment coupling structure 65.

Figure 19:
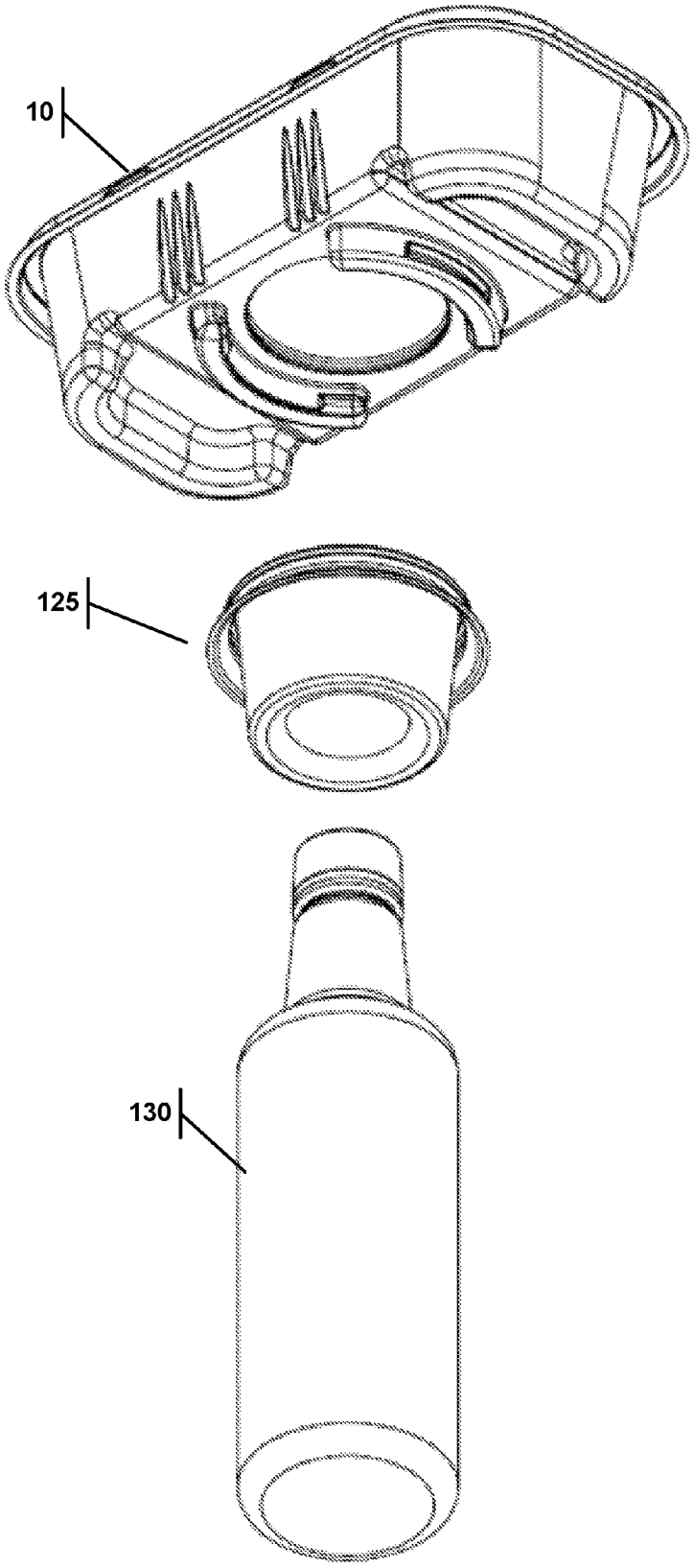
FIG. 19 is an exploded view of the bottle coupler, bottle and food container illustrated in FIGS. 17A-17C.
Figure 20A:
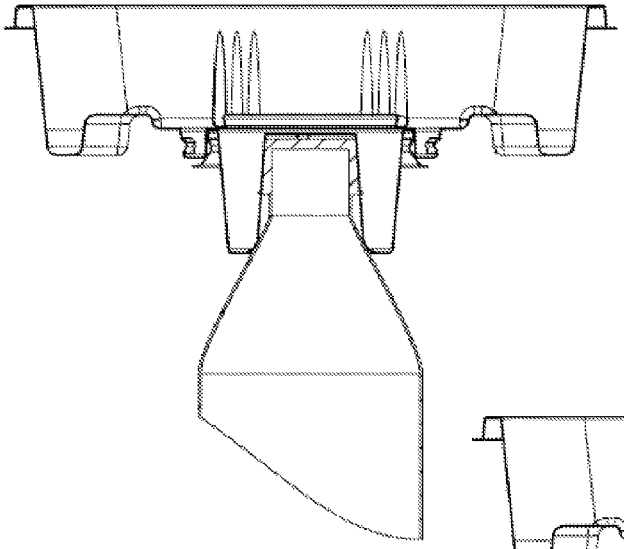
FIG. 20A illustrates the bottle coupler mated to a food container and mounted on a bottle with a short neck.
Figure 20B:
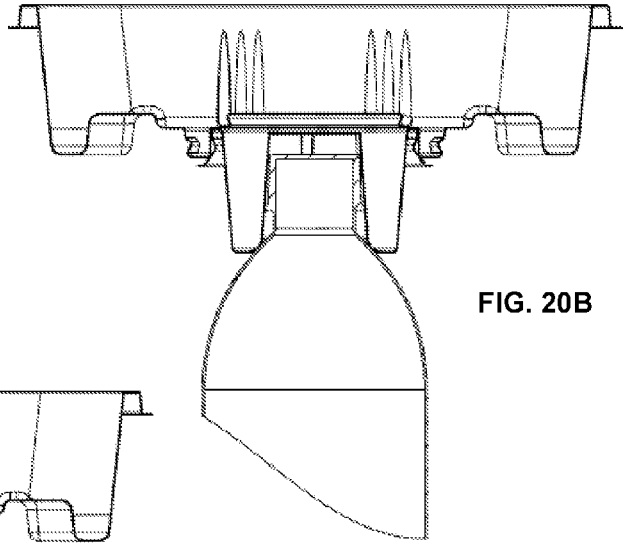
FIG. 20B illustrates the bottle coupler mated to a food container and mounted on a bottle with a short neck.
Figure 20C:
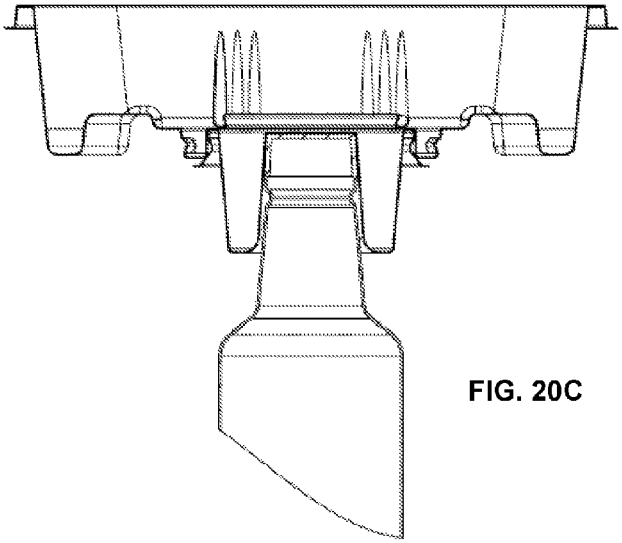
FIG. 20C illustrates the bottle coupler mated to a food container and mounted on a bottle with a long neck.

FIG. 19 provides an exploded view, showing that the bottle coupler 125 fits on top of the bottle 130. The food container 10 then fits on top of the bottle coupler 125 so that the food container 10 may be mounted on top of the bottle 130. FIG. 20A shows the food container 10 mounted to a differently shaped bottle (a short neck bottle), with a diagonal side wall jutting out from below the bottle cap. FIG. 20B shows the food container 10 mounted to another short-necked bottle, with the bottle side wall curving out from below the bottle cap. Both of these may be compared against FIG. 20C, which illustrates the food container 10 mounted onto an aluminum or glass bottle with a long bottle neck. In the first two cases where the short bottle neck 135 does not fit within the annular opening 138, the bottom of the bottle coupler 125 may rest on the bottle side wall, evenly distributing the weight of the food container 10 while the bottle cap fits snugly against the bottle coupler inner wall (annular opening) 138.

Figure 21C:
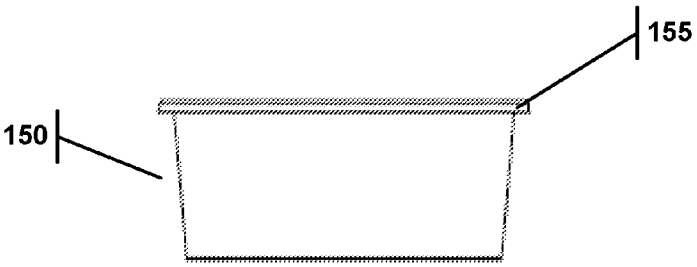
FIG. 21C is a side view of the bottle/small can/large can coupler illustrated in FIG. 21A.
Figure 21D:
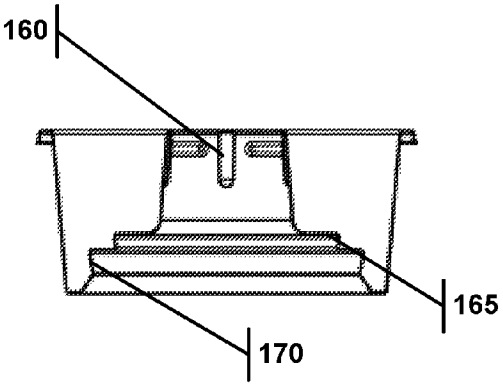
FIG. 21D is a cross-section side view of the bottle/small can/large can coupler illustrated in FIG. 21A.
Figure 21A:
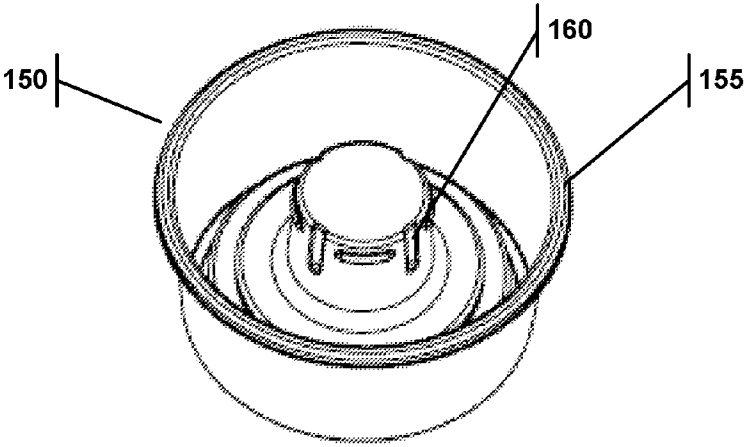
FIG. 21A is a top perspective view of a bottle/small can/large can coupler.
Figure 21B:
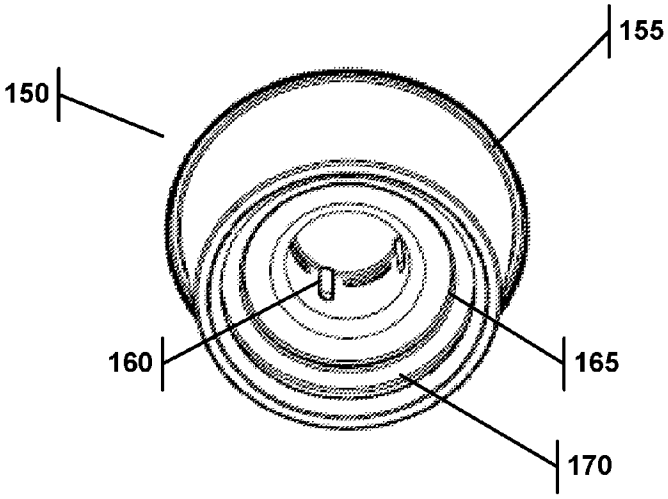
FIG. 21B is a bottom perspective view of the bottle/small can/large can coupler illustrated in FIG. 21A.

FIGS. 21A-D introduce another type of coupler, the bottle/small can/large can coupler 150, which comprises a bottle/small can/large can coupler coupling structure 155 and a bottle neck securing structure 160. What is different here is shown in FIG. 21B, which shows that the bottom of this bottle/small can/large can coupler 150 has a small can coupling structure 165, a large can coupling structure 170, and a bottle neck securing structure 160. Thus these three different annular openings in the bottle/small can/large can coupler 150 mate respectively to a bottle neck 135, a smaller diameter can 115, and a larger diameter can 35.

Only the outside of the coupler 150 can be seen in FIG. 21C, and in particular the bottle/small can/large can coupler coupling structure 155 is visible. In the cross-sectional view in FIG. 21D, it becomes clear that the bottle neck securing structure 160 has the smallest radius, the small can coupling structure 165 has a larger radius compared to the bottle neck securing structure 160, and the large can coupling structure 170 has the largest radius, larger than the radius of the small can coupling structure 165.

Figure 22A:
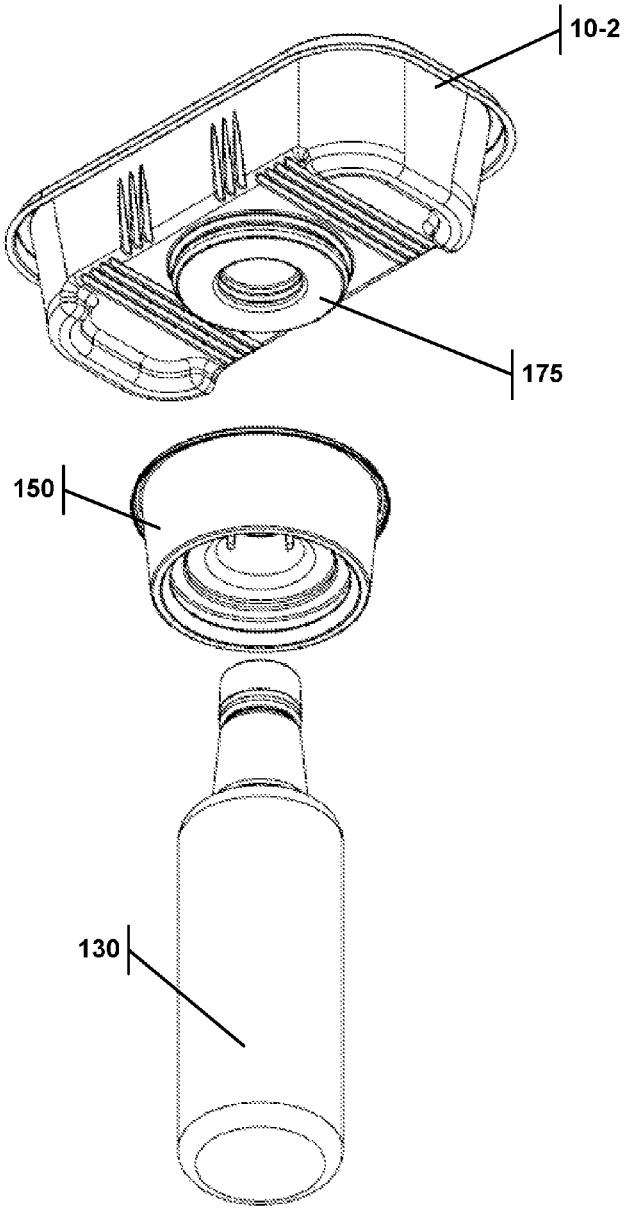
FIG. 22A is an exploded view of the bottle/small can/large can coupler, bottle, and food container.
Figure 22B:
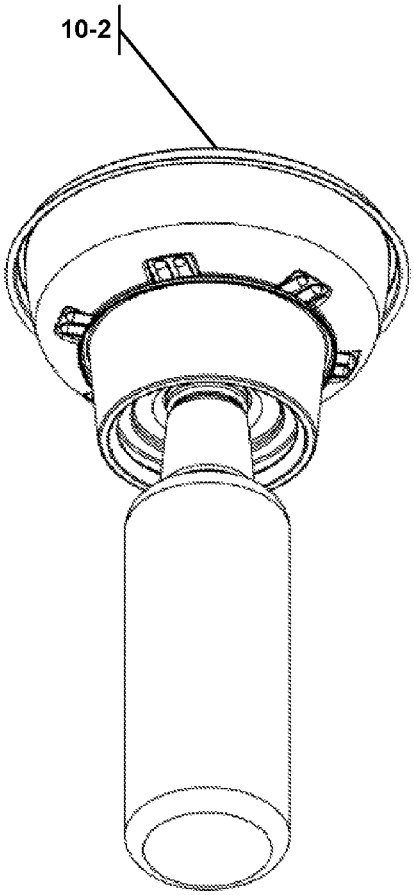
FIG. 22B is a perspective view of the bottle/small can/large can coupler, bottle, and circular food container mated together.

FIG. 22A presents an alternative embodiment of the food container 10-2. The food container 10-2 features a food container ring coupling structure 175 instead of the food compartment coupling structure 65 that consists of the minor arcs 95A and 95B. The food container ring coupling structure 175 extends from the bottom 60 of the food container 10-2 and fits entirely in the space between the bottle neck securing structure 160 and the bottle/small can/large can coupler coupling structure 155, with the inner wall of the food container ring coupling structure mating with the exterior wall of the bottle neck securing structure 160. As suggested by FIGS. 21A, 21B, 21C, and 22C, the bottle neck securing structure 160 of the bottle/small can/large can coupler 150 and the interior walls of the food container ring coupling structure 175 may have corresponding ribs or ridges that make for a more snug fit between the two structures.

Figure 22C:
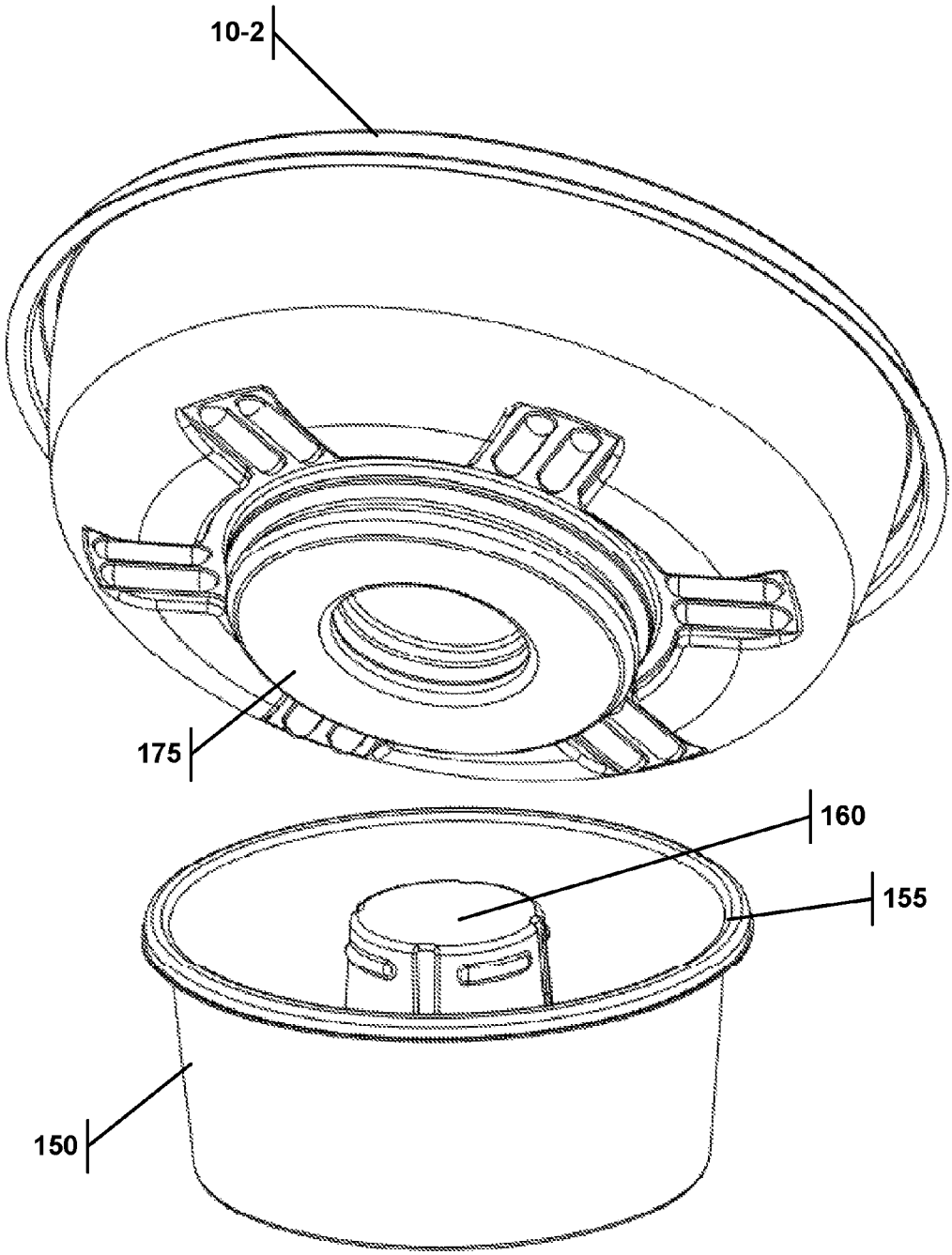
FIG. 22C is an exploded view of a circular container and bottle/small can/large can coupler.

It should be noted that the alternative embodiment food container 10-2 and the first embodiment food container 10 may have food compartments of various shapes, including but not limited to: square, rectangular, and circular food compartment footprints. Thus while FIG. 22A shows an exploded view featuring a food container 10-2 with a rectangular footprint, the circular footprint food compartment food containers featured in FIGS. 22B and 22C should also be recognized as the food container 10-2. In FIG. 22C, it is easy to see that the interior wall of the food container ring coupling structure 175 fits over the top of the bottle neck securing structure 160.

Figure 23A:
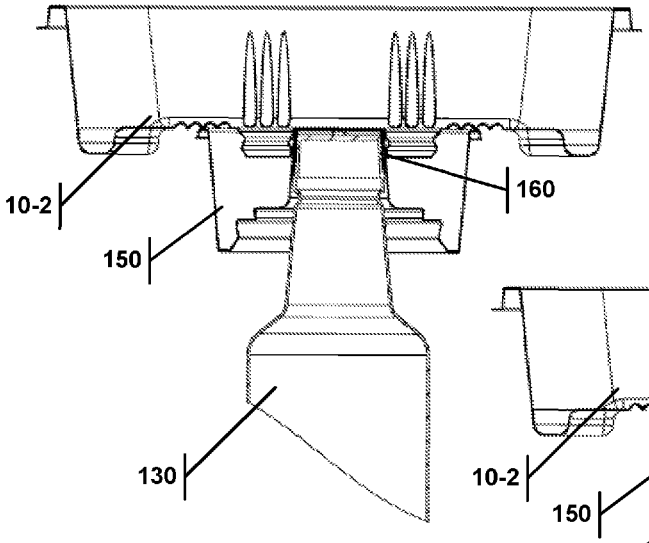
FIG. 23A illustrates the bottle/small can/large can coupler mated to a food container and mounted on a bottle.
Figure 23B:
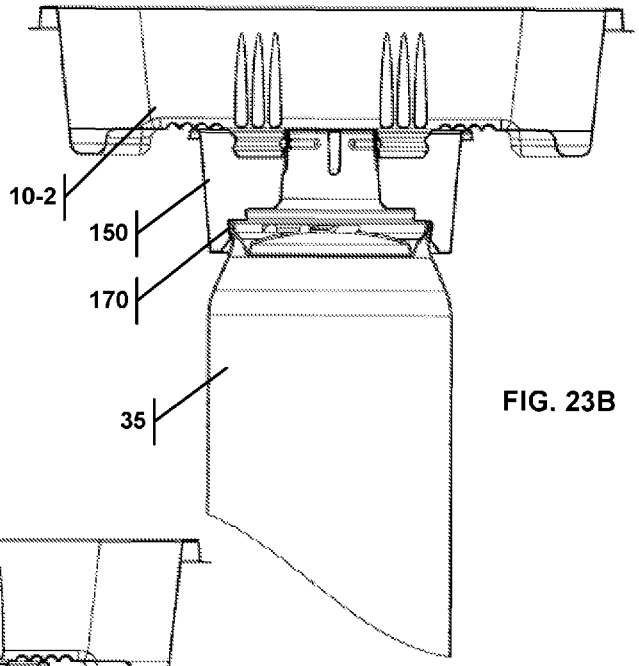
FIG. 23B illustrates the bottle/small can/large can coupler mated to a food container and mounted on a large beverage can.
Figure 23C:
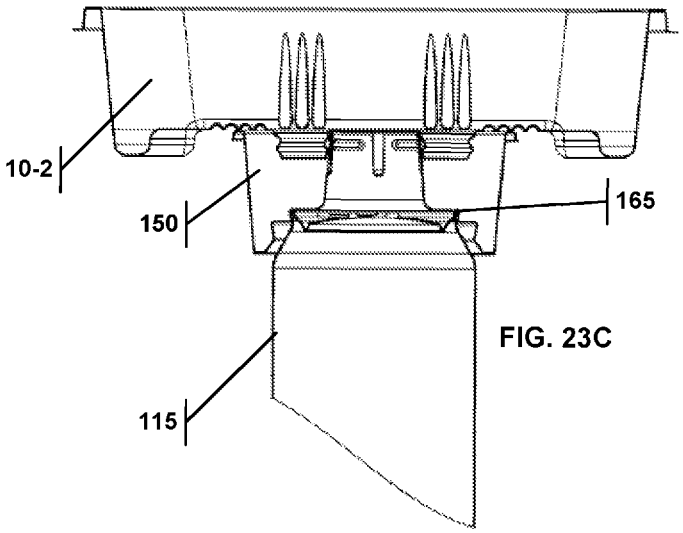
FIG. 23C illustrates the bottle/small can/large can coupler mated to a food container and mounted on a small beverage can.

FIG. 23A shows the food container 10-2 mounted atop a bottle 130 with the bottle/small can/large can coupler 150. Although not explicitly visible, the bottle/small can/large can coupler 150 attaches to the bottle 130 with the bottle neck securing structure 160. In FIG. 23A, the food container 10-2 is mounted atop a large beverage can 35 with a larger can radius, using the large can coupling structure 170 on the bottle/small can/large can coupler 150, which hooks underneath the rim 40 of the large beverage can 35. FIG. 23C portrays the food container 10-2 mounted atop a small beverage can 115. This small beverage can 115 has a smaller can radius/rim diameter, so the small can coupling structure 165, which hooks underneath the rim 120 of the small beverage can 115, is used to attach the bottle/small can/large can coupler 150 to the small beverage can 115.

Figure 24A:
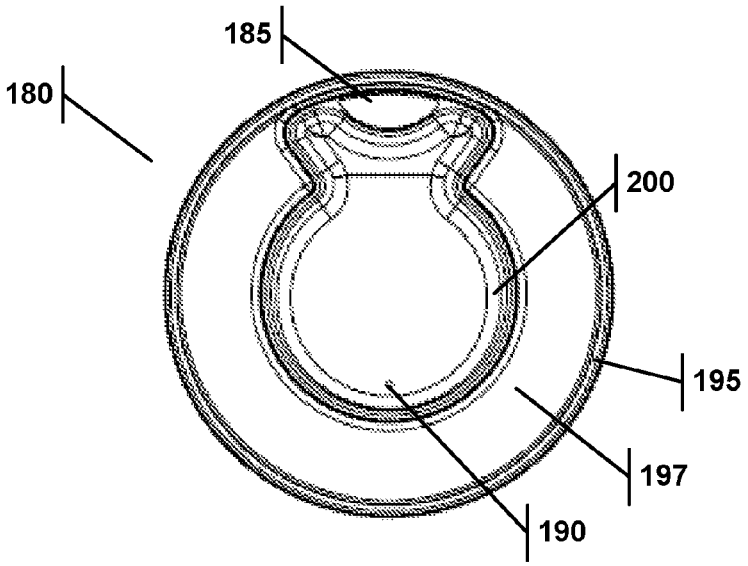
FIG. 24A is a top plan view of a second embodiment of a beverage container lid/coupler.
Figure 24B:
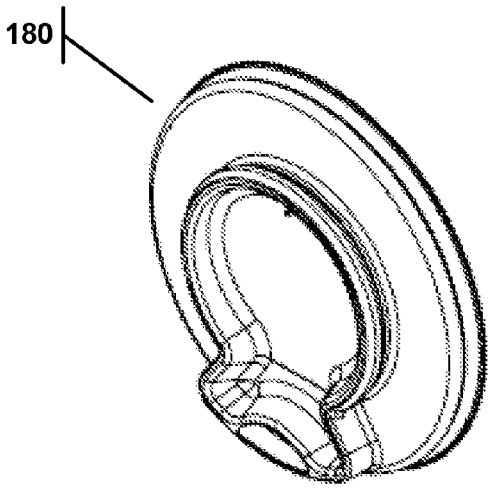
FIG. 24B is a side perspective view of the beverage container lid/coupler illustrated in FIG. 24A.
Figure 24C:
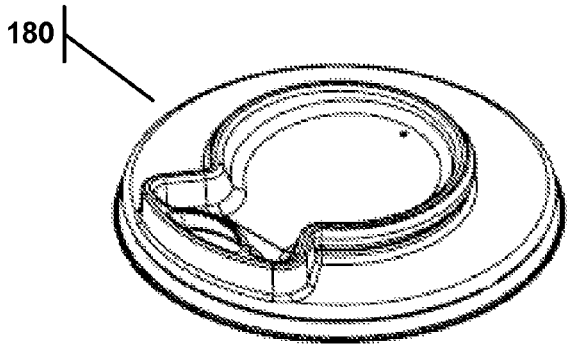
FIG. 24C is a perspective view of the beverage container lid/coupler illustrated in FIG. 24A.

FIGS. 24A-C illustrate various views of a second embodiment of a beverage container lid/coupler 180, with a lid coupling structure 200 as shown. There is a beverage container lid rim 195, which snaps over and mates with the rim of a beverage container 16, and the beverage container lid surface 197 is in substantially the same plane as the beverage container lid rim 195, while the lid coupling structure 200 extends away from this plane. This beverage container lid/coupler 180 may also optionally feature a hole 185 through which the beverage may be drunk, or, more conveniently, a straw inserted so as to foster better on-the-go eating and drinking. The lid/coupler 180 may also have a vent hole 190 that allows external air to enter the beverage container 16, which releases internal air vacuum pressure, allowing the beverage to flow more easily through the drink hole 185.

Figure 25A:
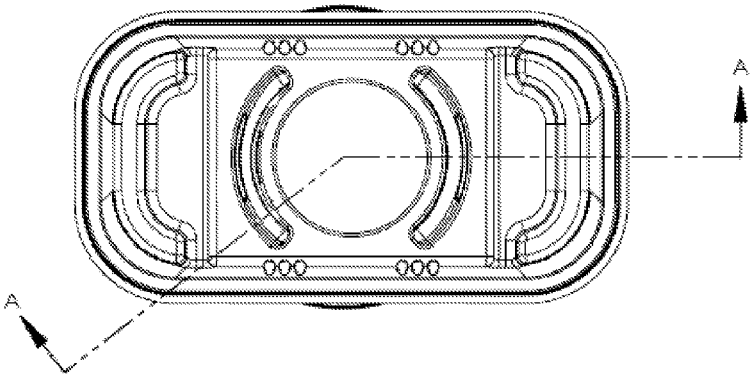
FIG. 25A is a top perspective view of the beverage container lid/coupler illustrated in FIGS. 24A-24C coupled to a food container.
Figure 25B:
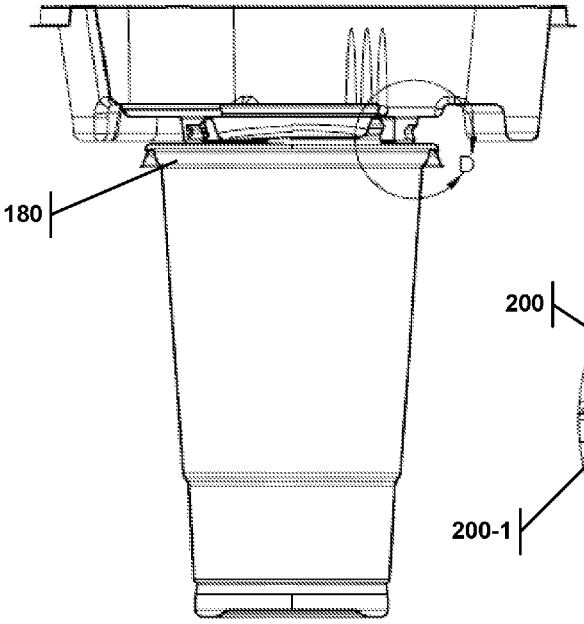
FIG. 25B is a cross-sectional view along line A-A of FIG. 25A.
Figure 25C:
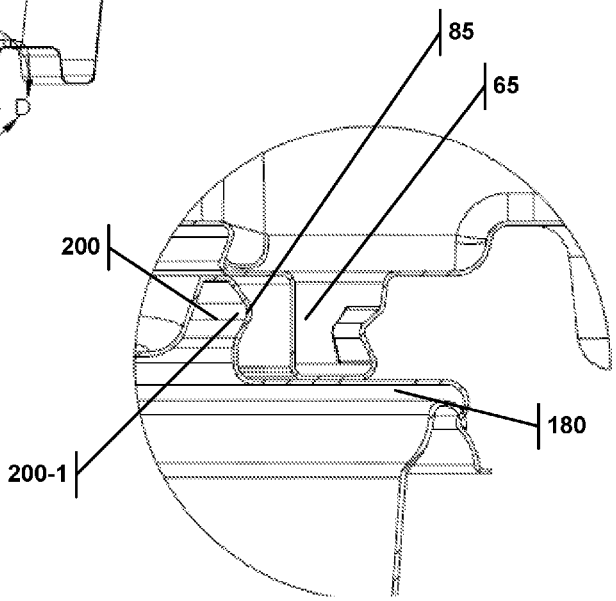
FIG. 25C is an enlarged cross-sectional view illustrating the mating of the second embodiment of the beverage container lid/coupler to a food container.
Figure 25D:
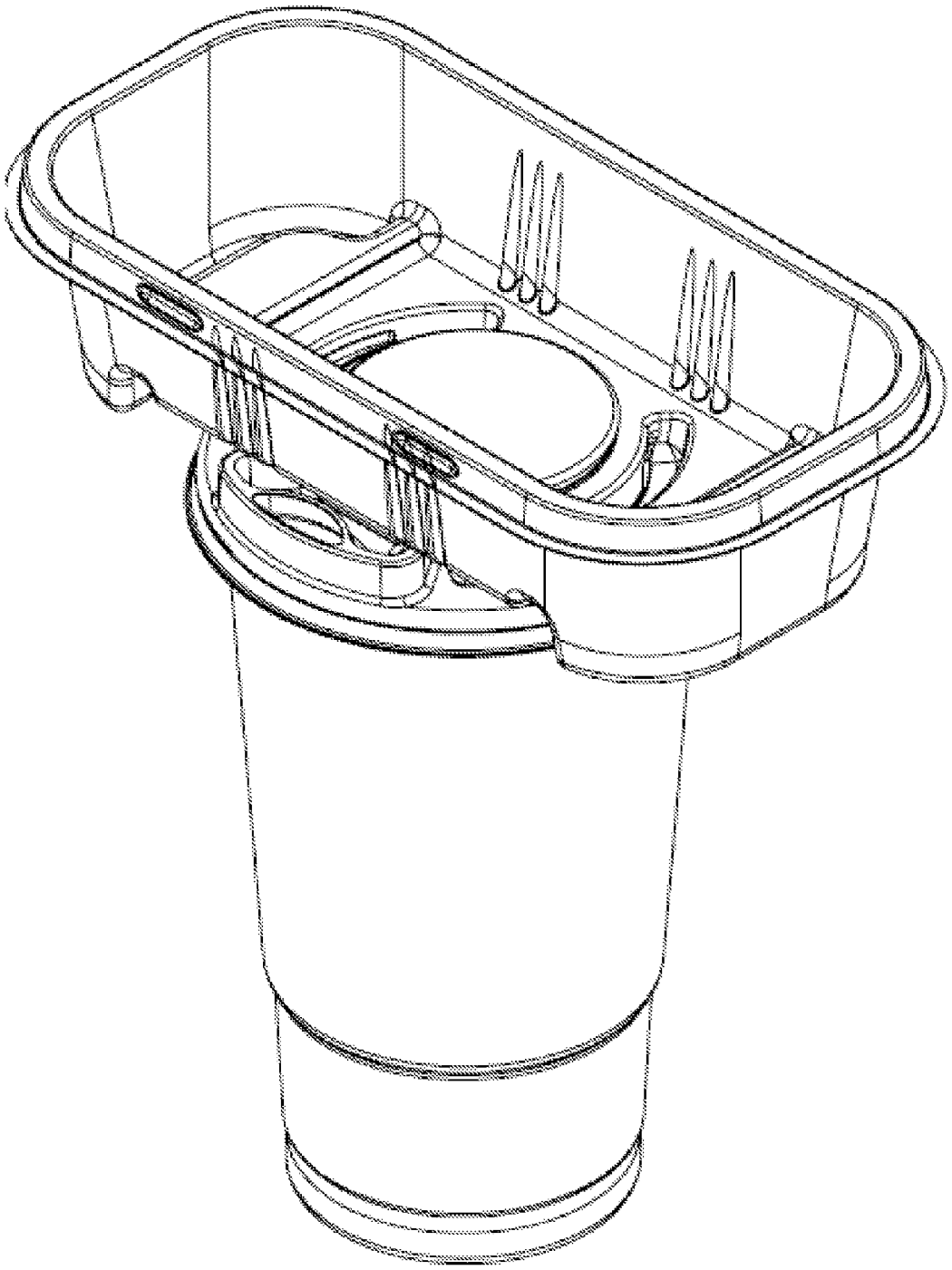
FIG. 25D is a top perspective view of the second embodiment of the beverage container lid/coupler coupled to a food container and a beverage container.

In FIG. 25A is a top perspective view of the beverage container lid/coupler 180, illustrated in FIGS. 24A-C, coupled to a food container. FIG. 25B is a cross-sectional view illustrating the differences between how the beverage container lid/coupler 15 attaches to the food compartment coupling structure 65 and how the alternative beverage container lid/coupler 180 attaches to the food compartment coupling structure 65 (compare FIG. 3C with FIG. 25C). The lid coupling structure 200 belonging to the beverage container lid/coupler 180 fits snugly against the inner wall 80 of the food compartment coupling structure 65, whereas the beverage lid/coupler 15 shown in FIG. 3C has a lid coupling structure 25 that mates with the outer wall coupling structure 75. Additionally, the beverage container lid/coupler 180 fits snugly against the inner wall coupling structure 85. As shown in FIG. 25C, the beverage container lid coupling structure 200 may include a jut, which may fit into an inner wall channel of the inner wall coupling structure 85. The inner wall coupling structure 85 may also have a jut that fits into a channel in the beverage container lid coupling structure 200. The coupling mechanism between the beverage container lid coupling structure 200 and the inner wall coupling structure 85 may have one or both of these features.

Figure 26A:
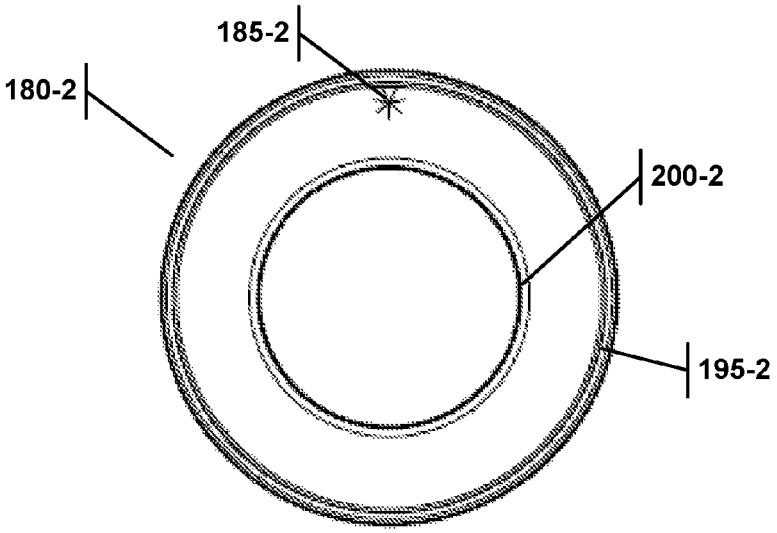
FIG. 26A is a top plan view of a third embodiment of a beverage container lid/coupler.
Figure 26B:
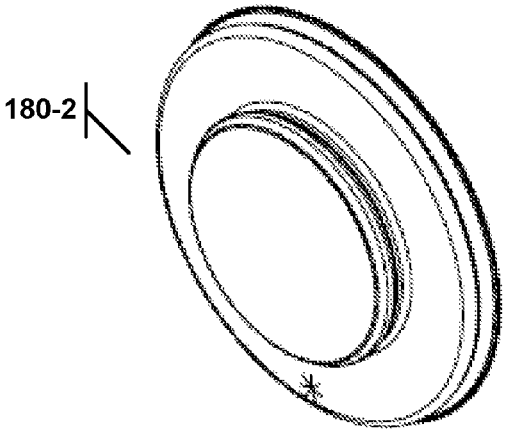
FIG. 26B is a side perspective view of the beverage container lid/coupler illustrated in FIG. 26A.
Figure 26C:
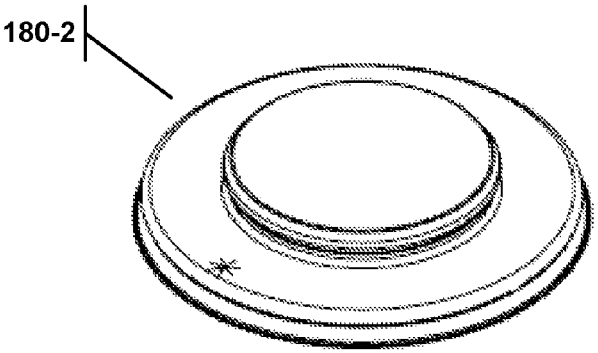
FIG. 26C is a perspective view of the beverage container lid/coupler illustrated in FIG. 26A.
Figures 27A, 27B, 27C, 27D, 27E:
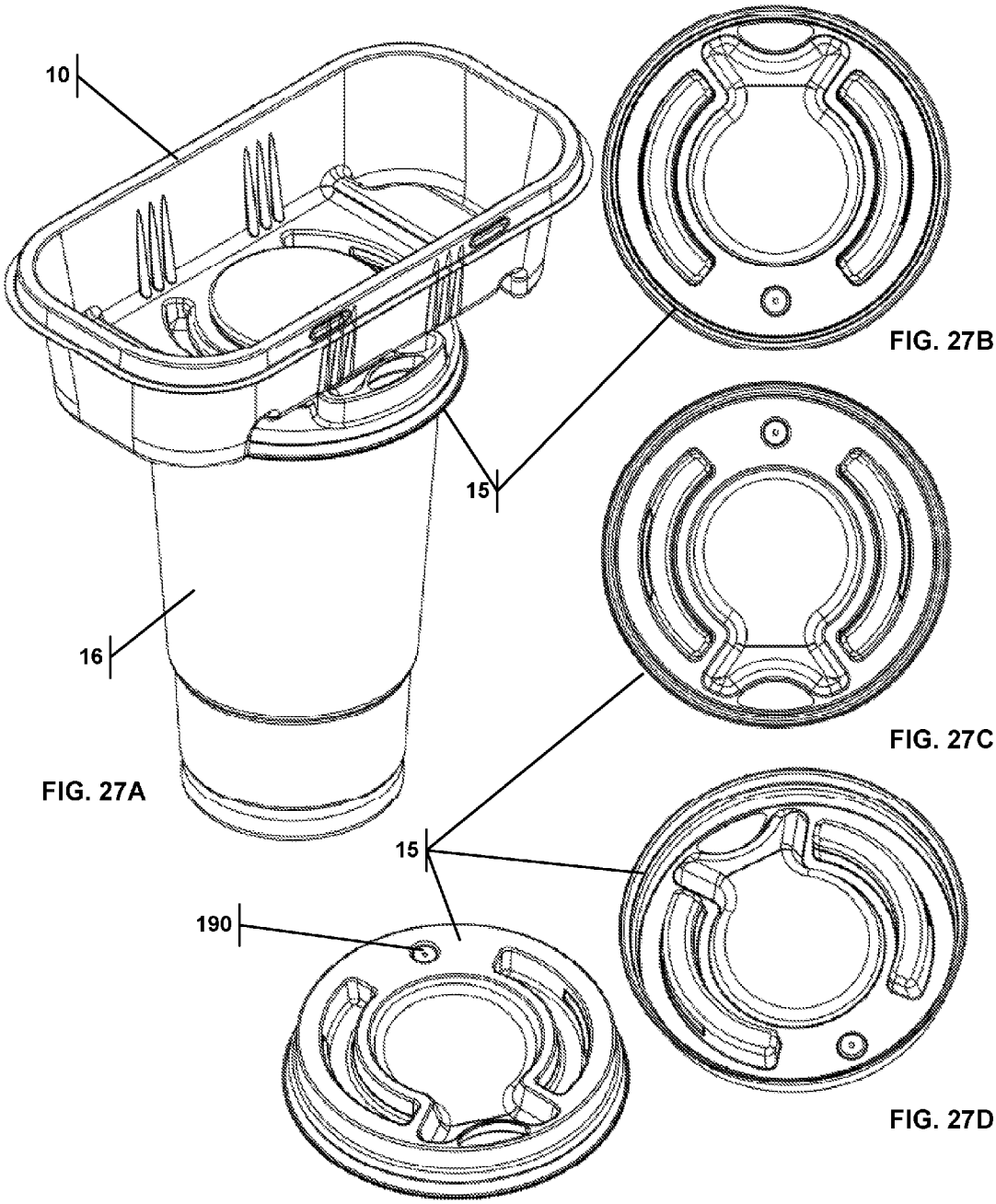
FIG. 27A illustrates a top perspective view of a novel food container mounted to a beverage container lid/coupler.
FIG. 27B illustrates a top view of the beverage container lid/coupler of FIG. 27A.
FIG. 27C illustrates a bottom view of the beverage container lid/coupler of FIG. 27A.
FIG. 27D illustrates a bottom perspective view of the beverage container lid/coupler of FIG. 27A.
FIG. 27E illustrates a top perspective view of the beverage container lid/coupler of FIG. 27A.

FIGS. 26A-C introduce a third embodiment beverage container lid/coupler 180-2. This lid/coupler 180-2 also has a lid rim 195-2, and a lid coupling structure 200-2 that extends away from the plane of the lid rim 195-2. Optionally, there is a hole 185-2 for inserting a straw into the beverage container to drink the beverage. Depending on the height and radius of the lid coupling structure 200-2, it can attach to an inner can coupler 110 or the inner wall coupling structure 85 of a food compartment coupling structure 65. Additionally, the lid coupling structure 200-2 on the beverage container lid/coupler 180-2 may feature a distinct rim to be gripped by the inner can coupler 110 or the inner wall coupling structure 85.

Figure 28A:
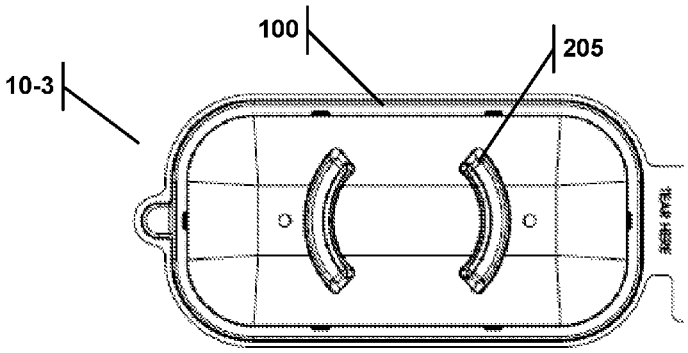
FIG. 28A is a top plan view of a food container with a top cover coupling structure that allows food containers to be securely mounted on top of each other.
Figure 28B:
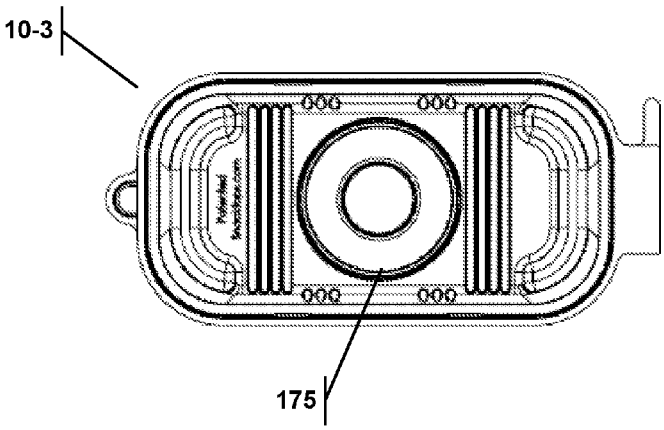
FIG. 28B is a bottom plan view of the food container of FIG. 28A.

FIGS. 27A-E illustrate multiple perspective views of beverage container lid/coupler 15. In particular, note how the hole 185 is accessible even when the food container 10 is mounted atop the beverage container 16. FIG. 28 illustrates how food containers may be stacked on top of one another. Another alternative embodiment of the food container, 10-3, features a cover 100 with a food container cover coupling structure 205, shown in FIG. 28A. As shown by FIG. 28B, the food container 10-3 has a food container ring coupling structure 175 at the bottom, such that the cover coupling structure 205 may be mated with a ring coupling structure 175.

Figure 29A:
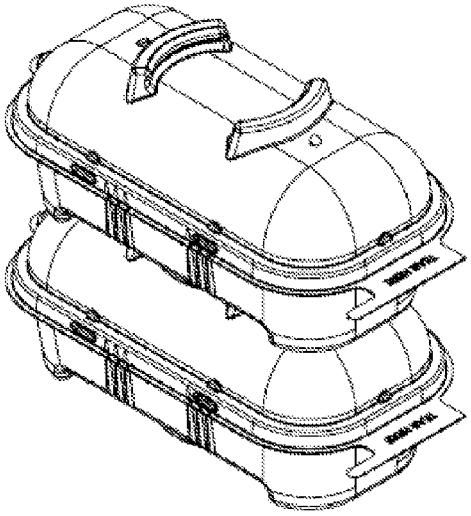
FIG. 29A is a perspective view of two food containers constructed in accordance with FIGS. 28A and 28B, and mounted on top of each other.
Figure 29B:
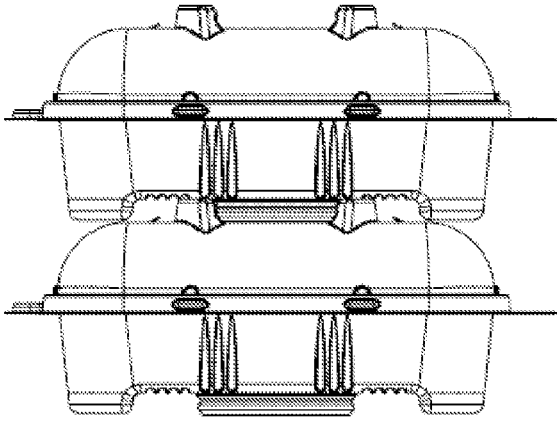
FIG. 29B is a side view of two food containers constructed in accordance with FIGS. 28A and 28B, and mounted on top of each other.

One or more food containers 10-3 can be mated to one another and are stackable as depicted in FIG. 29A and FIG. 29B.

Figure 30A:
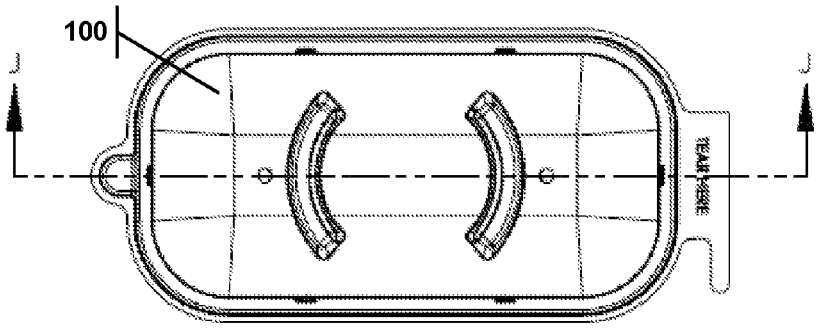
FIG. 30A is a top plan view of a novel food container mounted on top of another food container.
Figure 30B:
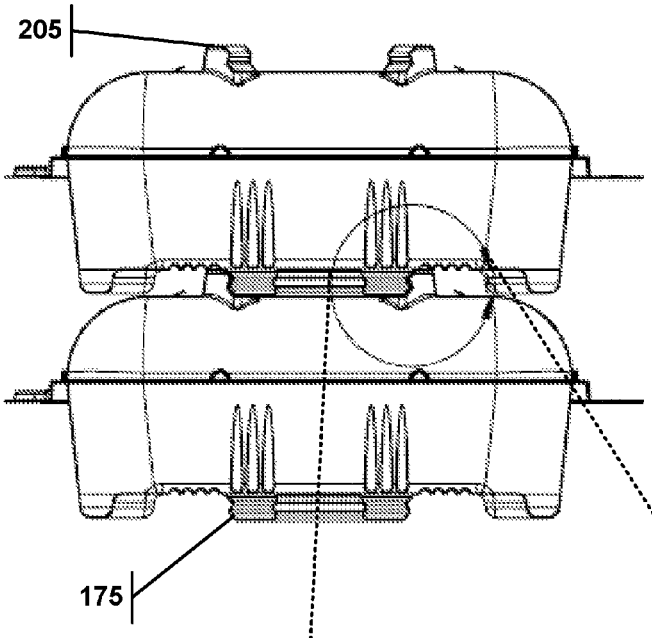
FIG. 30B is a cross-sectional view along line J-J of FIG. 30A.
Figure 30C:
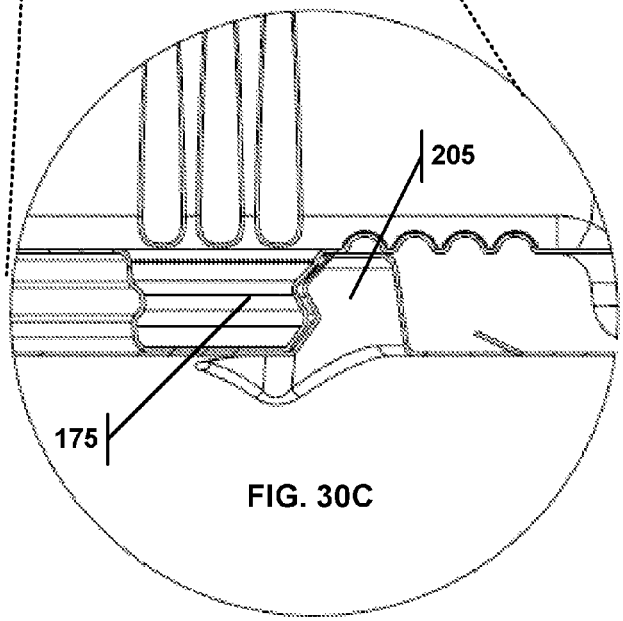
FIG. 30C is an enlarged cross-sectional view illustrating the mating of the top cover coupling structure to the food container ring coupling structure.
Figure 31:
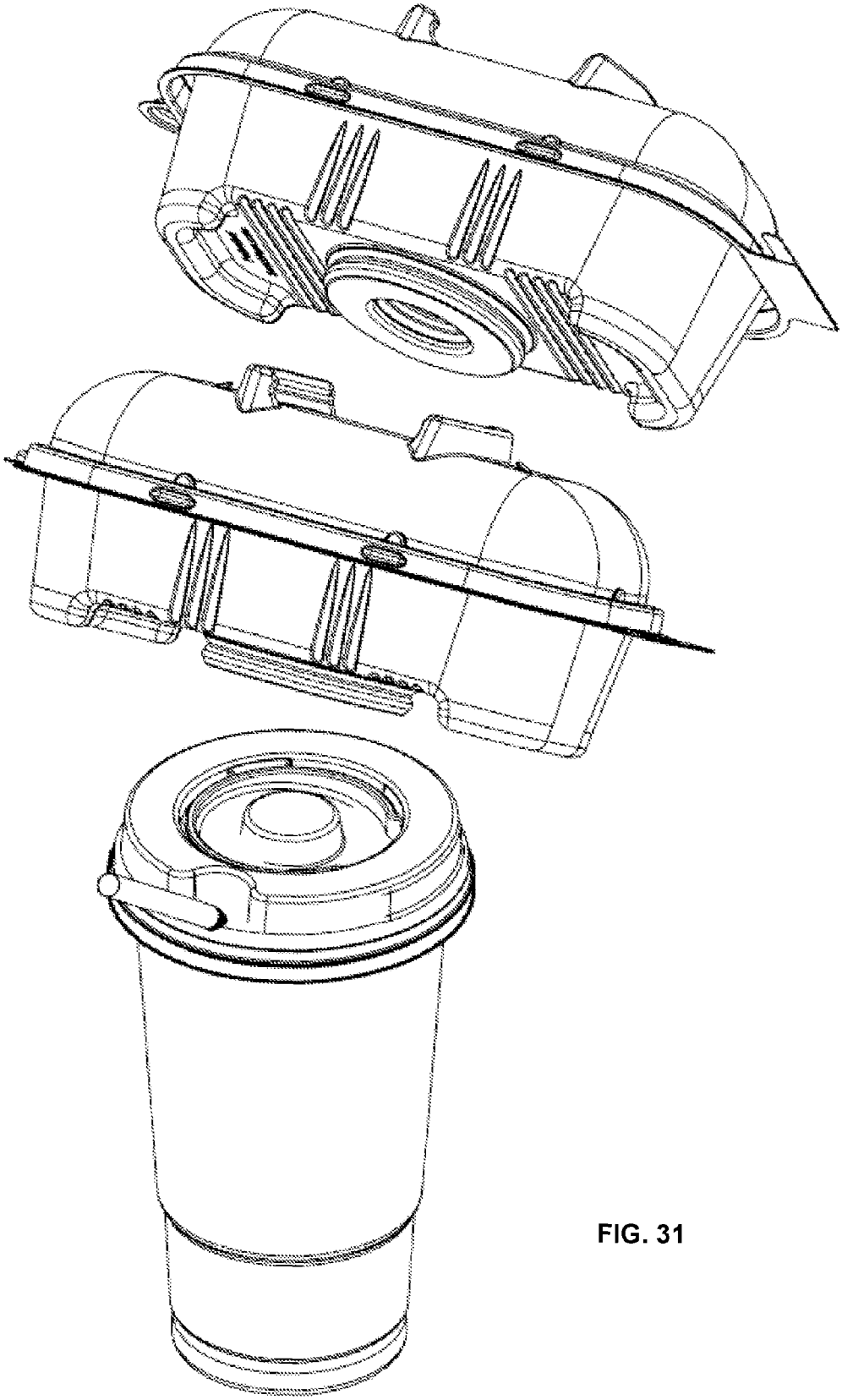
FIG. 31 is a perspective exploded view illustrating a food container mounted to a food container which is mounted to a beverage container lid/coupler.
Figure 32A:
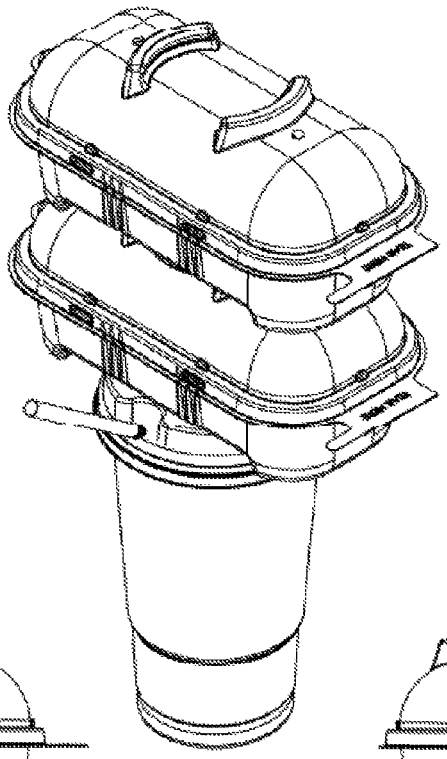
FIG. 32A is a top perspective view illustrating a food container mounted to a food container which is mounted to a beverage container lid/coupler.
Figure 32B:
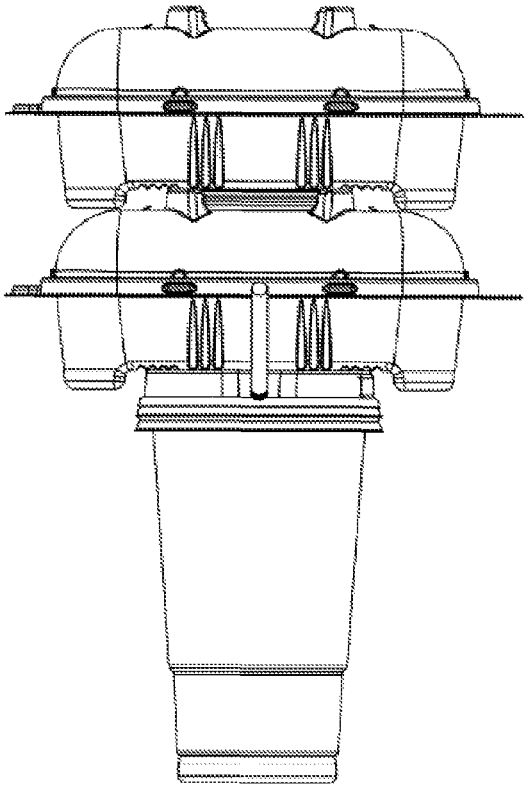
FIG. 32B is a front view illustrating a food container mounted to a food container which is mounted to a beverage container lid/coupler.
Figure 32C:
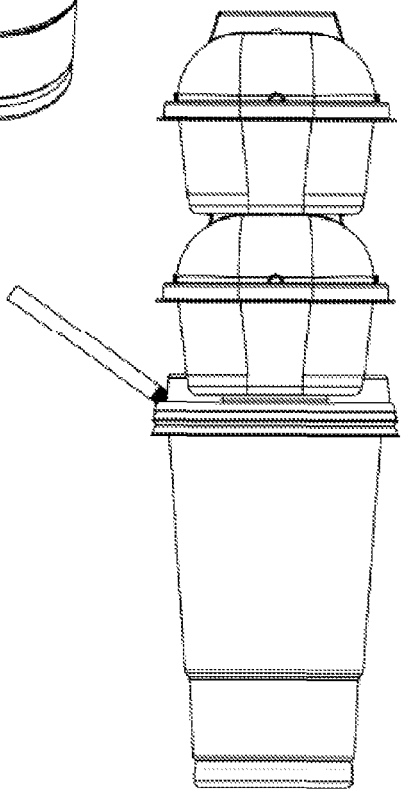
FIG. 32C is a side view illustrating a food container mounted to a food container which is mounted to a beverage container lid/coupler.

To illustrate this further, FIG. 30A provides a top plan view with the line J-J. FIG. 30B is the cross-sectional view along line J-J. FIG. 30C is an enlarged cross-sectional view that shows the food container ring coupler structure 175 mating with the food container cover coupling structure 205. FIG. 31 is a top perspective exploded view of two stackable food containers 10-3 on top of a beverage container 16, and FIGS. 32A-C provide a top perspective view and two side views of the two food containers 10-3 stacked on top of the beverage container 16.

Figure 33A:
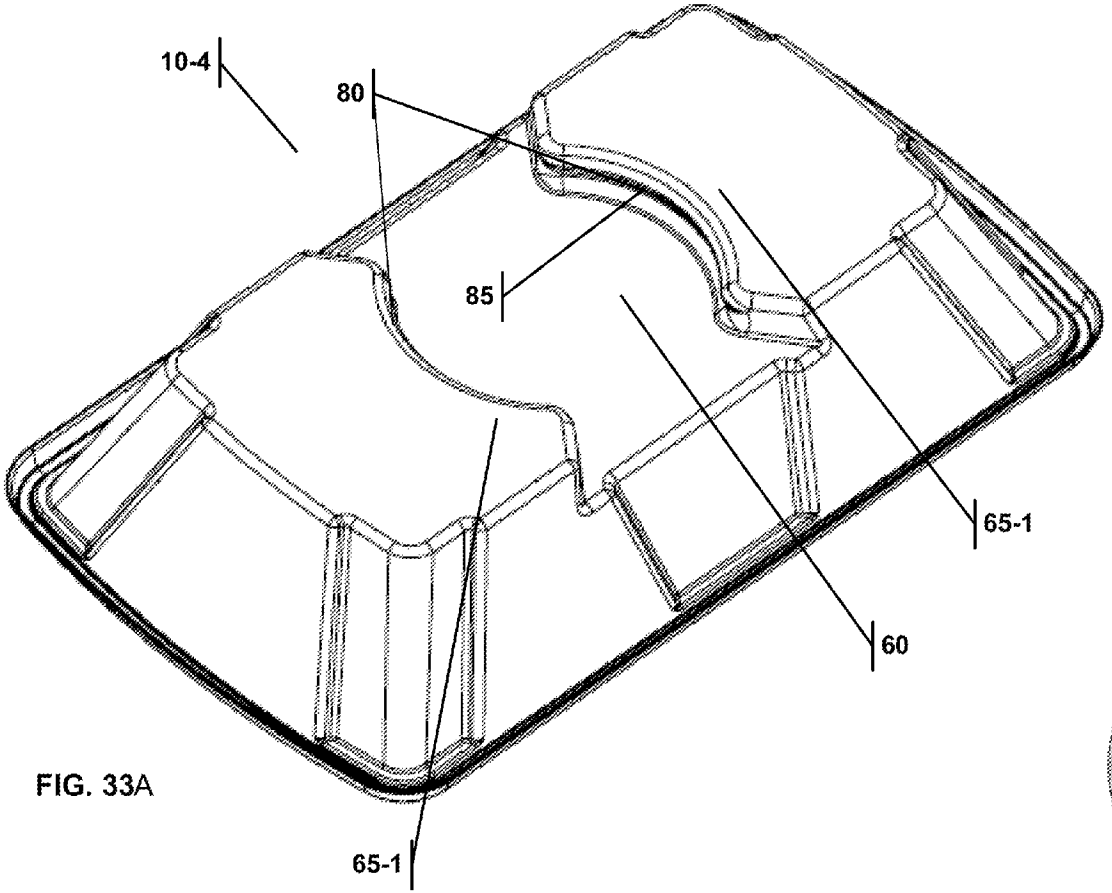
FIG. 33A is a bottom perspective view of a fourth embodiment of a food container.
Figure 33B:
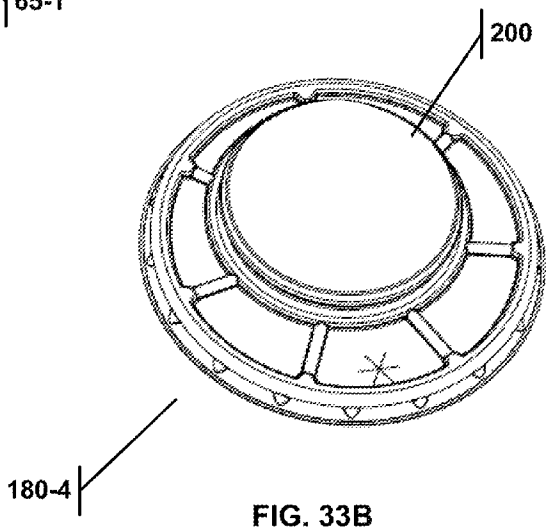
FIG. 33B is a perspective view of a fifth embodiment of a beverage container lid/coupler.

FIG. 33A is a bottom perspective view of a fourth embodiment of a food container 10-4. The food container 10-4 features, at the bottom 60 of the container 10-4, the food compartment coupling structure 65-1, which extends from the bottom 60 and is comprised of the inner wall 80 with an inner wall coupling structure 85. The food compartment coupling structure 65-1 shown in FIG. 33 is mated to the lid coupling structure 200 shown in FIG. 33B.

Figure 34A:
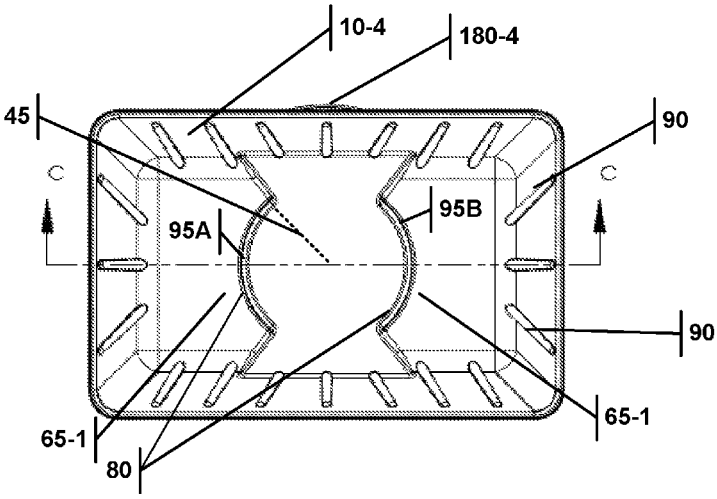
FIG. 34A is a top plan view of the novel food container of FIG. 33A mounted to an off-center beverage container lid/coupler.
Figure 34B:
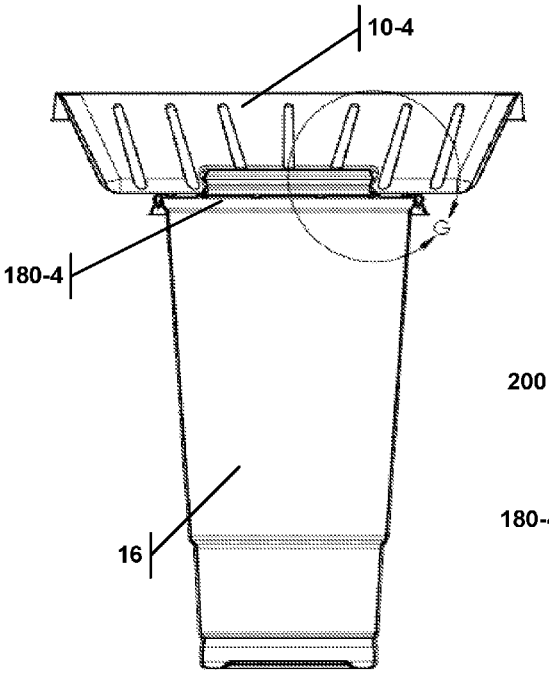
FIG. 34B is a cross-sectional view along line C-C of FIG. 34A.
Figure 34C:
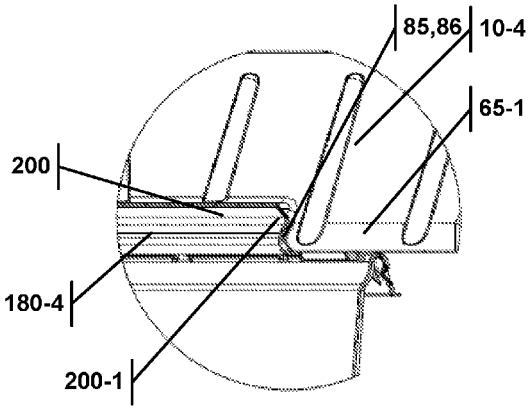
FIG. 34C is an enlarged cross-sectional view illustrating the mating of the lid coupling structure to the food compartment coupling structure.

FIGS. 34A-C illustrate in detail how the food compartment coupling structure 65-1 mates with the lid coupling structure 200 so that the food container 10-4 may be mounted on top of a beverage container 16. FIG. 34A provides a top plan view showing the food compartment coupling structure 65-1. Also illustrated are the inner wall 80, and the strengthening ribs 90. The inner walls 80 of the food compartment coupling structure 65-1 have a second radius 45. While the food compartment coupling structure 65-1 could be any shape, in one variation it could form a minor arc. In particular to what is drawn in FIG. 34A, the food compartment coupling structure 65-1 may be comprised of the food compartment coupling structure minor arcs 95A and 95B, as shown. It should be understood however, that the depiction of the food compartment coupling structure 65-1 as consisting of minor arcs 95A and 95B does not limit the food compartment coupling structure 65-1 to minor arcs. FIG. 34B is a cross-sectional view along line C-C shown in FIG. 34A. Section G in FIG. 34B is enlarged as FIG. 34C, which provides a more detailed look at how the two coupling structures may work together.

In FIG. 34C, the beverage container lid coupling structure 200 may include a jut, which may fit into an inner wall channel of the inner wall coupling structure 85. The inner wall coupling structure 85 may also have a jut that fits into a channel in the beverage container lid coupling structure 200. The coupling mechanism between the beverage container lid coupling structure 200 and the inner wall coupling structure 85 may have one or both of these features. Further the food compartment coupling structure 65-1 may include an inner wall jut 86 that juts away from the inner wall 80 of the food compartment coupling structure 65-1 to fit under and grip the beverage container lid coupling structure jut 200-1.

Figure 35A:
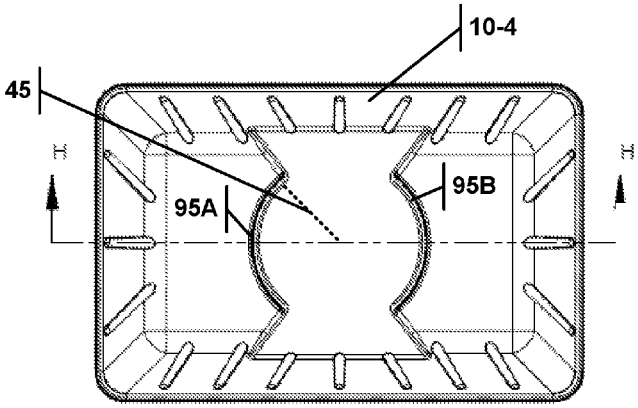
FIG. 35A is a top plan view of the novel food container of FIG. 33A mounted to a beverage can.
Figure 35B:
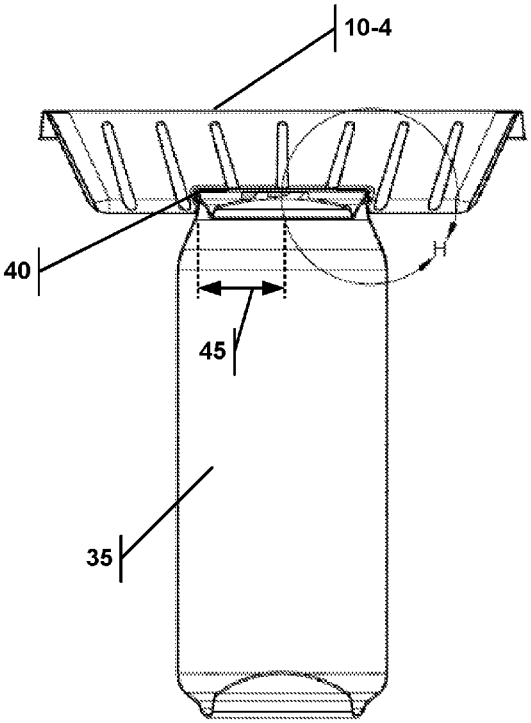
FIG. 35B is a cross-sectional view along line H-H of FIG. 35A.
Figure 35C:
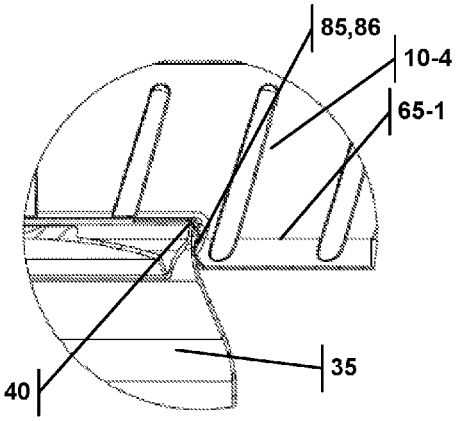
FIG. 35C is an enlarged cross-sectional view illustrating the mating of the lid coupling structure to the rim of a beverage can.

FIGS. 35A-C indicate how the same food container 10-4 may be mounted on top of a beverage can 35. FIG. 35A provides the same top plan view, while FIG. 35B provides a cross-sectional view along the line H-H drawn in FIG. 35A. FIG. 4B illustrates how the inner wall 80 of the food compartment coupling structure 65-1 couples with the can rim 40 of the beverage can 35. The inner wall 80 has a second radius 45, which matches the radius of the top of the beverage can 35. Section B in FIG. 35B is enlarged as FIG. 35C to better demonstrate how the food container 10-4 may be mounted atop a large beverage can 35.

In FIG. 35C, the inner wall coupling structure 85 includes an inner wall jut 86 that juts away from the inner wall 80 of the food compartment coupling structure 65-1 to grip the rim 40 of the large beverage can 35. The inner wall jut 86 secures the food container 10-4 to the rim 40 of the beverage can 35. While in FIGS. 35A-C a larger radius (25 oz) beverage can 35 is illustrated, the inner wall coupling structure 85 works in the same way with smaller beverage cans of the same can radius, since beverage cans could have a standard rim diameter that matches the diameter of the inner wall 80 of the food compartment coupling structure 65-1. It would be apparent to those skilled in the art, that the radius of the food compartment coupling structure 65-1 can be changed to accommodate cans with larger or smaller radiuses.

FIGS. 36A through 36E illustrate several beverage container lid/couplers (180, 180-3, 180-4, 180-5, 180-6) that each have a beverage container lid coupling structure 200 protruding above the beverage container lid surface 197. These lid/couplers (180, 180-3, 180-4, 180-5, 180-6) differ from the beverage container lid/coupler 15 (FIG. 2) discussed above in that these lid/couplers (180, 180-3, 180-4, 180-5, 180-6) have a male profile such that the food container does not insert into the lid/coupler. (Compare lid/coupler 15 in FIG. 3C to lid/coupler 180-4 in FIG. 34C). These lid/couplers (180, 180-3, 180-4, 180-5, 180-6) may also optionally feature a hole 185 through which the beverage may be drunk, or, more conveniently, a straw inserted so as to foster better on-the-go eating and drinking. The lid/couplers (180, 180-3, 180-4, 180-5, 180-6) may also have a vent hole 190 that allows external air to enter the beverage container 16, which releases internal air vacuum pressure, allowing the beverage to flow more easily through the drink hole 185.

Figure 36A:
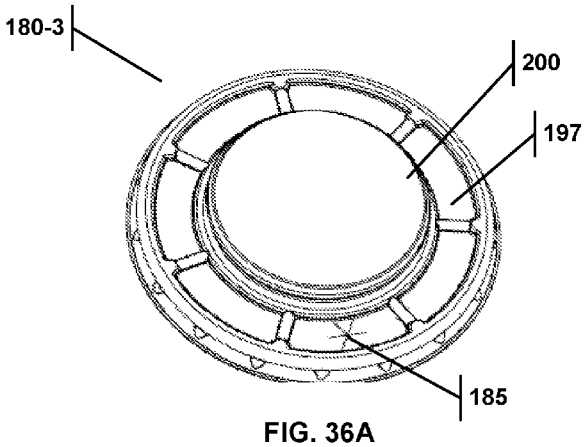
FIG. 36A is a perspective view of a fourth embodiment of a beverage container lid/coupler.
Figure 36B:
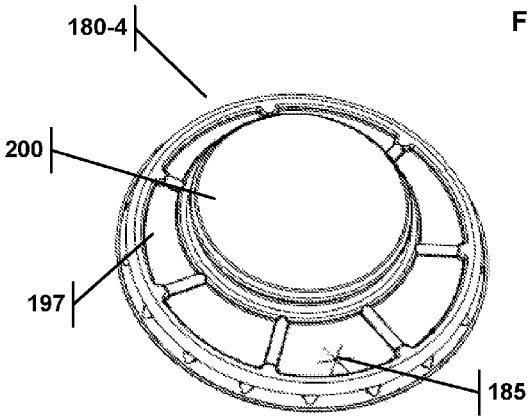
FIG. 36B is a perspective view of a fifth embodiment of a beverage container lid/coupler.
Figure 36C:
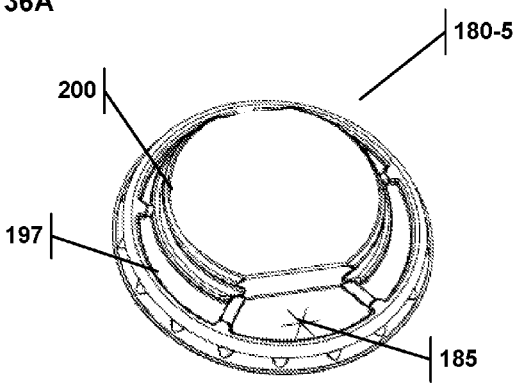
FIG. 36C is a perspective view of a sixth embodiment of a beverage container lid/coupler.
Figure 36D:
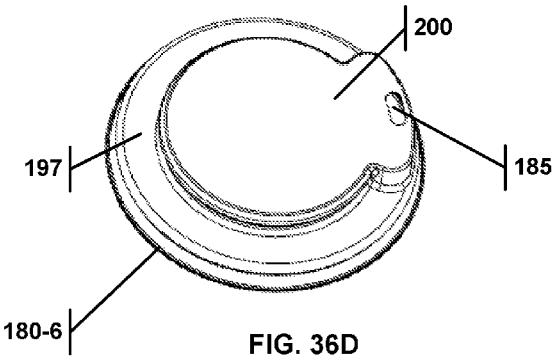
FIG. 36D is a perspective view of a seventh embodiment of a beverage container lid/coupler.
Figure 36E:
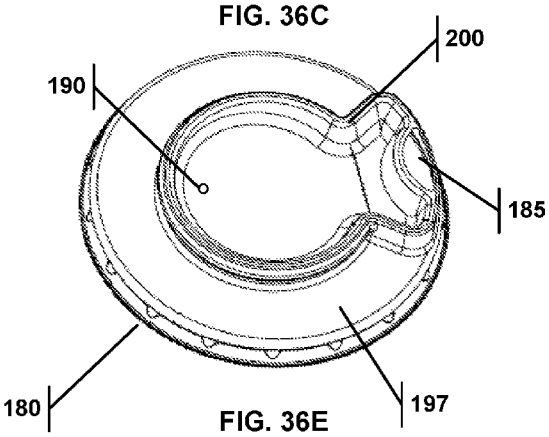
FIG. 36E is a perspective view of the second embodiment of a beverage container lid/coupler.
Figure 37A:
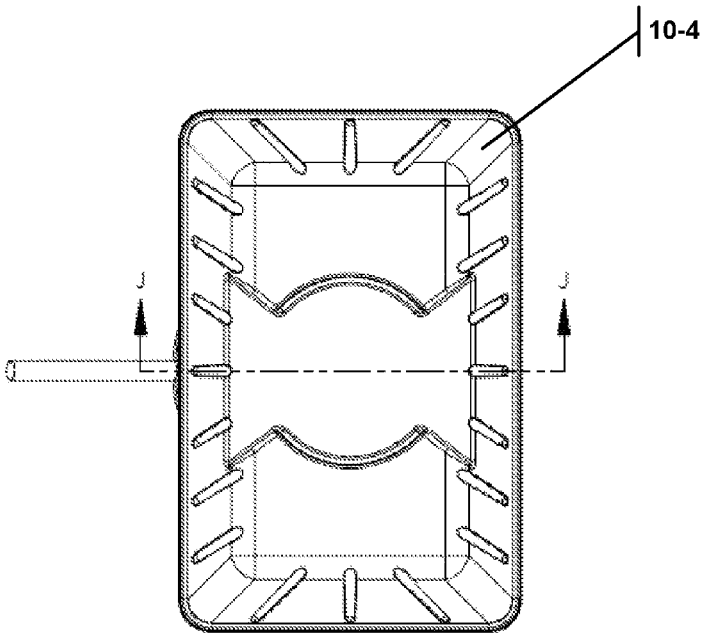
FIG. 37A is a top plan view of the novel food container of FIG. 33 mounted to a off-center beverage container lid/coupler with a straw inserted into the hole.
Figure 37B:
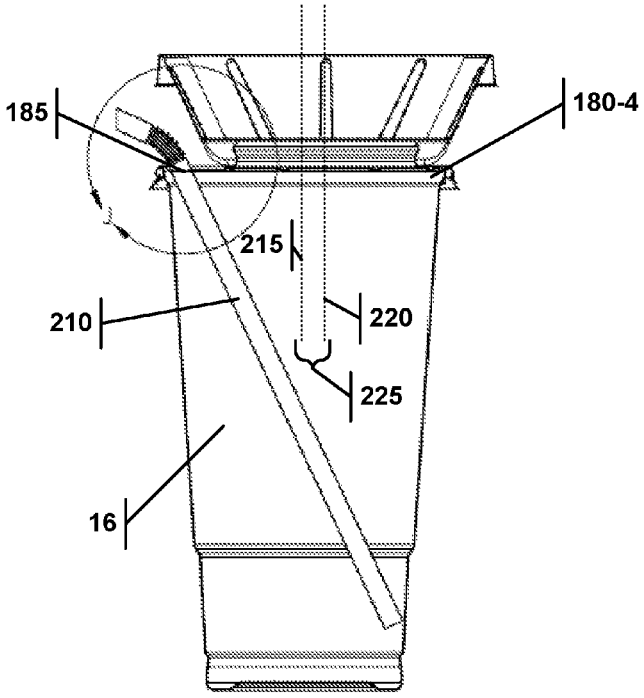
FIG. 37B is a cross-sectional view along line J-J of FIG. 37A.
Figure 37C:
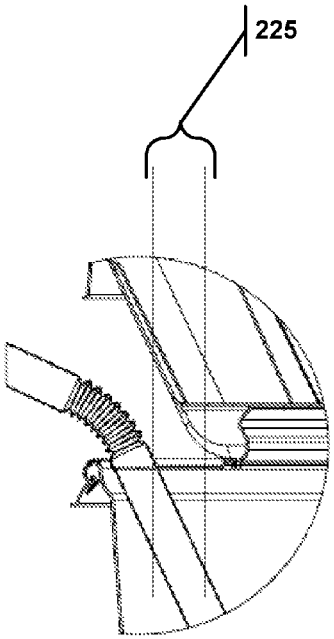
FIG. 37C is an enlarged cross-sectional view illustrating the mating of the lid coupling structure to the food compartment coupling structure.

It should also be noted that in FIGS. 36B and 36C, the lid/couplers (180-4, 180-5) have a beverage container lid coupling structure 200 that is offset from the center. This allows for easier access to the hole 185 when the food container is mounted as shown in FIGS. 37A-C. The center line of the beverage container is shown as line 215, whereas the centerline of the beverage container cover coupling structure is center line 220. The offset 225 between these centerlines, allows the straw 210 to more easily access the hole 185.

Figure 38A:
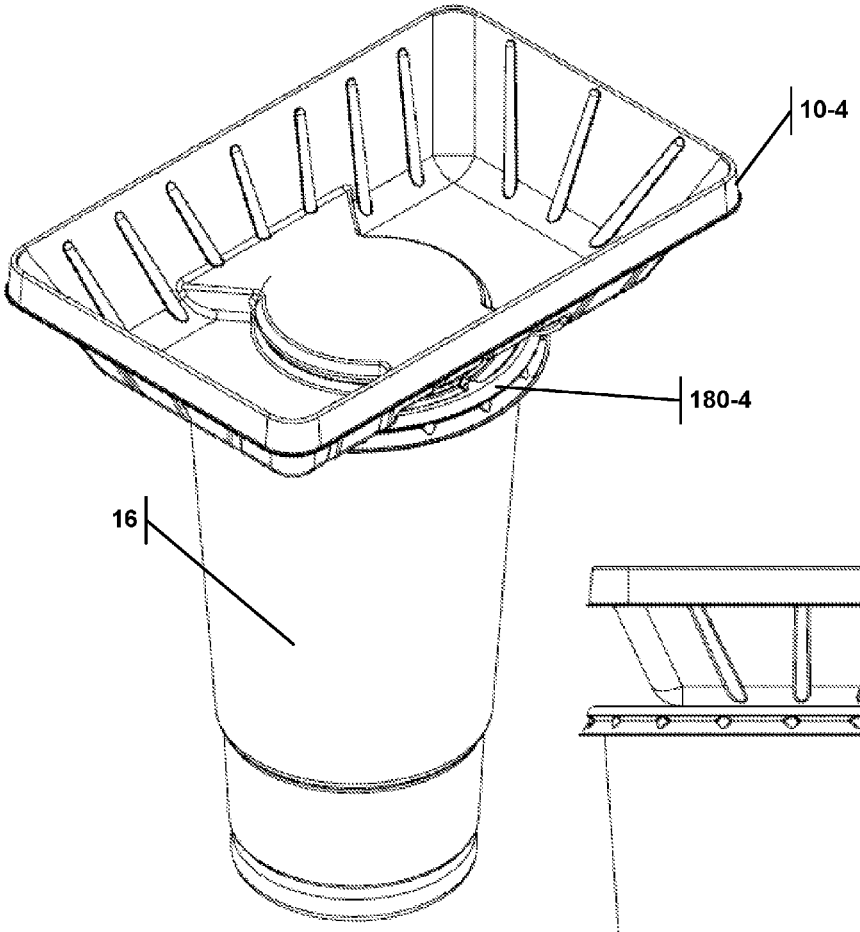
FIG. 38A is a top perspective view of the food container mounted to the beverage container lid/coupler.
Figure 38B:
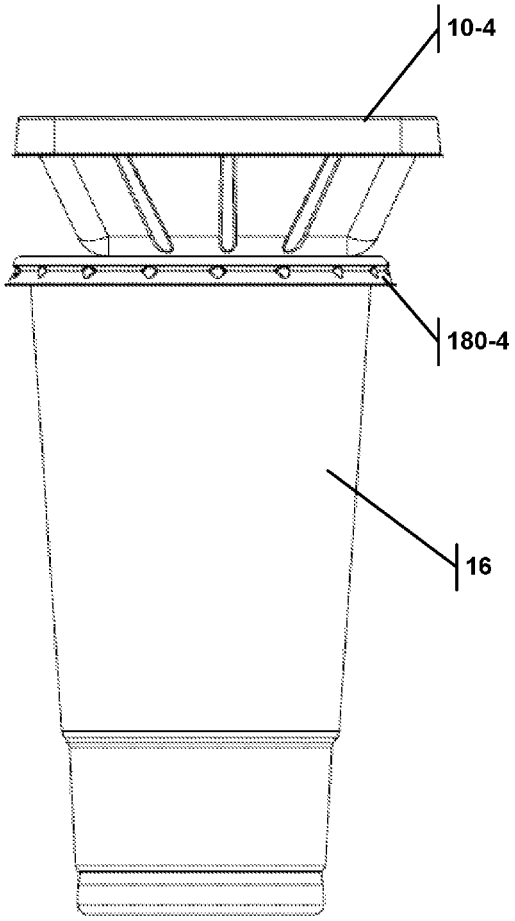
FIG. 38B is a side view of the food container mounted to the beverage container lid/coupler.
Figure 39A:
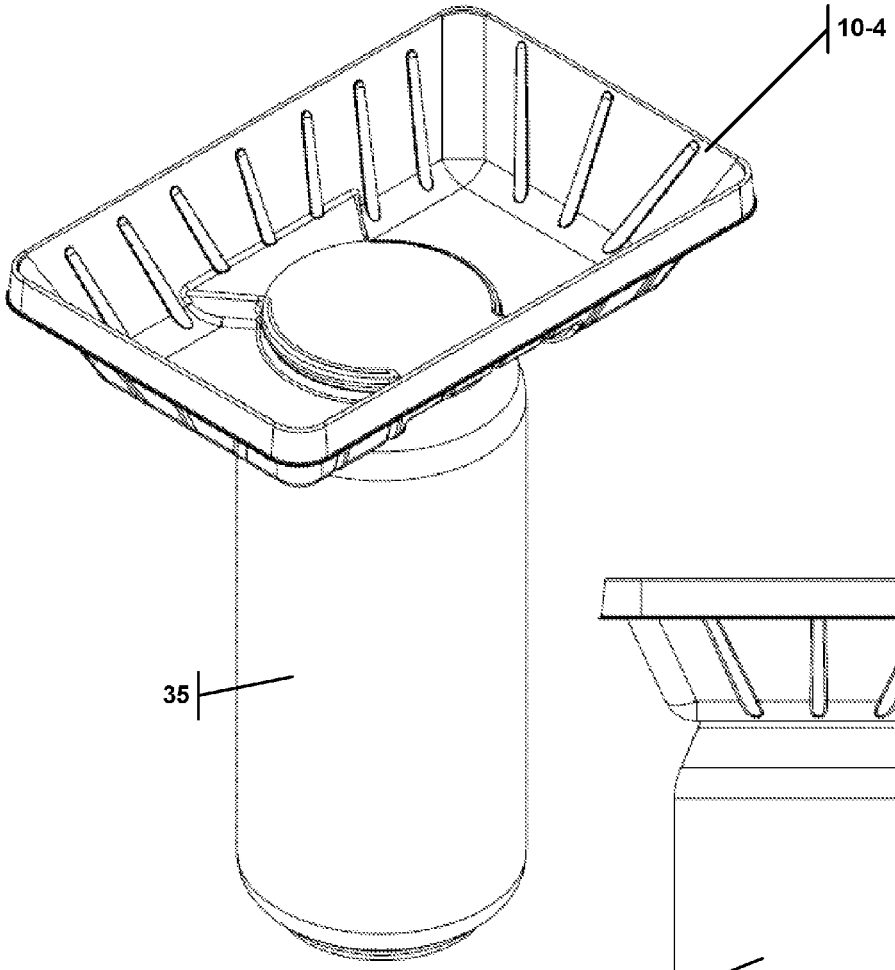
FIG. 39A is a top perspective view of the food container mounted to a beverage can.
Figure 39B:
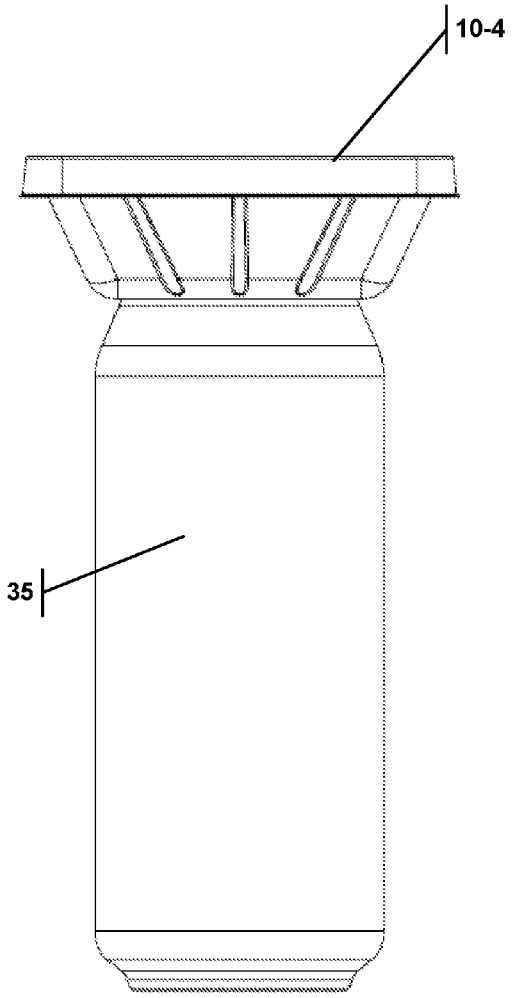
FIG. 39B is a side view of the food container mounted to a beverage can.

FIGS. 38A and 38B show the fourth embodiment of a food container 10-4 coupled and mounted atop the fifth embodiment of a beverage container lid/coupler 180-4, which in turn is coupled to a beverage container 16. FIGS. 39A and 39B show the fourth embodiment of a food container 10-4 coupled and mounted atop a beverage can 35.

The food container, lids and coupling structures described above can be manufactured using a variety of conventional techniques, including but not limited to thermoforming. Thermoforming is a manufacturing process where a plastic sheet is heated to a pliable forming temperature, formed to a specific shape via a mold, and trimmed to create a usable product. The sheet or roll is heated in an oven-type structure to a high-enough temperature that it can be formed via a mold at which point the formed part is cooled, thereby retaining its finished shape. Thermoforming is a reliable and inexpensive manufacturing process that is utilized for many conventional single-use food packaging containers. All of the parts illustrated herein may also be injection molded which is a viable method for manufacturing reusable parts.

The food container, lids and coupling structures described above may be monolithic, meaning that these pieces may be created from a single, uniform sheet of plastic. Alternatively, these pieces may be made from different materials. For example, the lid may be an opaque black, the food container may be an opaque white which provides a more visually appealing presentation of the food within the food container. And the cover may be constructed of transparent plastic, allowing the user to visually verify that the food contained in the food container is indeed what was ordered.

The types of material would be apparent to one of skill in the art and may include, by non-limiting example, PP (polypropylene), PET (polyethylene terephthalate), CPET, RPET 25 Polyethylene (HDPE/LDPE), styrene, HIPS, HMWPE, PP/PE blends, or custom blends. The above description of the disclosed embodiments is provided to enable any person skilled in the art to make or use the invention.

Various modifications to these embodiments will be readily apparent to those skilled in the art, and the generic principles described herein can be applied to other embodiments without departing from the spirit or scope of the invention. Thus it is to be understood that the description and drawings presented herein represent a presently-preferred embodiment of the invention and are therefore representative of the subject matter which is broadly contemplated by the present invention. It is further understood that the scope of the present invention fully encompasses other embodiments that may become obvious to those skilled in the art, and that the scope of the present invention is accordingly limited by nothing other than the appended claims.

The invention claimed is:

1. A food container coupling system, the system comprising:

a food container configured to attach to a bottle coupler, the food container comprising:

a food compartment comprising a side wall and a bottom;

a food compartment coupling structure extending from the bottom;

the bottle coupler comprising a top rim and a bottle coupler coupling structure extending from the top rim; the bottle coupler further comprising an annular opening adapted to fit around an unthreaded neck of a bottle;

wherein the bottle coupler further comprises at least one bottle neck securing structure comprising one or more inward protrusions in the annular opening adapted to place pressure against the neck of the bottle thereby stabilizing the position of the bottle coupler to the bottle;

wherein when the food container is mounted to the bottle coupler, the food compartment coupling structure mates with the bottle coupler coupling structure.

2. The system of claim 1, wherein the annular opening is further adapted to fit around a rim of a small can and the bottle coupler comprises a small can coupling structure adapted to secure the bottle coupler to the rim of the small can.

3. The system of claim 2, wherein when the bottle coupler is mounted to a small beverage can, and the small can coupling structure hooks underneath the rim of the small can.

4. The system of claim 2, wherein the annular opening is further adapted to fit around a rim of a large can and the bottle coupler comprises a large can coupling structure adapted to secure the bottle coupler to the rim of the large can.

5. The system of claim 4, wherein when the bottle coupler is mounted to a large beverage can, and the large can coupling structure hooks underneath the rim of the large can.

6. The system of claim 1, the food container further comprising a cover adapted to cover the food compartment.

7. The system of claim 6, wherein the cover further comprises a top portion coupling structure adapted to securely mate with the food compartment coupling structure extending from the bottom of a second food container.

8. The system of claim 6, further comprising a hinge connected to the side wall and the cover.

9. The food container coupling system of claim 1, the food compartment coupling structure further comprising one or more ribs, and the bottle neck securing structure further comprising one or more corresponding ribs adapted to mate snugly with the one or more ribs of the food compartment coupling structure.

* * * * *